US010410442B2

(12) United States Patent
Fankhauser et al.

(10) Patent No.: US 10,410,442 B2
(45) Date of Patent: Sep. 10, 2019

(54) SIMULTANEOUS AUTHENTICATION OF A SECURITY ARTICLE AND IDENTIFICATION OF THE SECURITY ARTICLE USER

(71) Applicant: SICPA HOLDING SA, Prilly (CH)

(72) Inventors: Catherine Fankhauser, Chavannes-de-Bogis (CH); Mehdi Talwerdi, North Vancouver (CA)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 15/539,563

(22) PCT Filed: Jan. 28, 2016

(86) PCT No.: PCT/EP2016/051803
§ 371 (c)(1),
(2) Date: Jun. 23, 2017

(87) PCT Pub. No.: WO2016/120383
PCT Pub. Date: Aug. 4, 2016

(65) Prior Publication Data

US 2018/0018836 A1 Jan. 18, 2018

(30) Foreign Application Priority Data

Jan. 30, 2015 (EP) ..... 15153221

(51) Int. Cl.
*G08B 13/14* (2006.01)
*G07C 9/00* (2006.01)

(52) U.S. Cl.
CPC ..... *G07C 9/00087* (2013.01); *G08B 13/14* (2013.01)

(58) Field of Classification Search
CPC ..... G07C 9/00087; G06Q 20/40145
(Continued)

(56) References Cited

U.S. PATENT DOCUMENTS 4,705,300 A 11/1987 Berning et al.
4,705,356 A 11/1987 Berning et al.
(Continued)

FOREIGN PATENT DOCUMENTS

EP 0601483 6/1994
EP 0686675 2/1998
(Continued)

OTHER PUBLICATIONS

G. Pfaff and P. Reynders, "Angle-Dependent Optical Effects Deriving from Submicron Structures of Films and Pigments", Chem. Rev. 99 (1999), pp. 1963-1981.
(Continued)

*Primary Examiner* — Toan N Pham
(74) *Attorney, Agent, or Firm* — Muncy, Geissler, Olds & Lowe, P.C.

(57) ABSTRACT

Operating a security checkpoint for authenticating a security article, comprising capturing biographic information from the security article; detecting a physical property of a security feature on and/or in the security article; processing the captured biographic information and the detected physical property on and/or in the security article to determine whether the security article is genuine; and operating a gate, moveable between a closed position, to be moved from the closed to the open position depending on the determination.

15 Claims, 5 Drawing Sheets

(58) Field of Classification Search
USPC ..... 340/572.1, 568.1, 5.74, 5.8, 8.81, 5.82, 340/5.83, 5.86, 5.81
See application file for complete search history.

(56) References Cited

U.S. PATENT DOCUMENTS

| | | | | |
|---|---|---|---|---|
| 4,721,271 | A | 1/1988 | Goldstein et al. | |
| 4,838,648 | A | 6/1989 | Phillips et al. | |
| 5,084,351 | A | 1/1992 | Philips et al. | |
| 5,211,877 | A | 5/1993 | Andrejewski et al. | |
| 5,214,530 | A | 5/1993 | Coombs et al. | |
| 5,281,480 | A | 1/1994 | Phillips et al. | |
| 5,362,315 | A | 11/1994 | Müller-Rees et al. | |
| 5,383,995 | A | 1/1995 | Phillips et al. | |
| 5,569,535 | A | 10/1996 | Phillips et al. | |
| 5,571,624 | A | 11/1996 | Phillips et al. | |
| 5,650,729 | A | 7/1997 | Potter | |
| 6,410,130 | B1 | 6/2002 | Schuhmacher et al. | |
| 6,423,246 | B1 | 7/2002 | Kasch et al. | |
| 6,531,221 | B1 | 3/2003 | Schuhmacher et al. | |
| 6,570,648 | B1 | 5/2003 | Müller-Rees et al. | |
| 6,582,781 | B1 | 6/2003 | Schuhmacher et al. | |
| 6,732,961 | B2 | 5/2004 | Leigeber et al. | |
| 6,838,166 | B2 | 1/2005 | Phillips et al. | |
| 7,416,688 | B2 | 8/2008 | Pfaff et al. | |
| 7,802,724 | B1 * | 9/2010 | Nohr | G07C 9/00111 235/384 |
| 8,127,989 | B2 * | 3/2012 | Choi | G07C 9/02 235/382 |
| 8,186,573 | B2 * | 5/2012 | Callegari | G06K 19/086 235/375 |
| 8,243,356 | B2 | 8/2012 | Robertsson et al. | |
| 9,053,596 | B2 * | 6/2015 | Blair | G07D 7/122 |
| 9,789,977 | B2 * | 10/2017 | Yepez | B64F 1/366 |
| 9,894,240 | B1 * | 2/2018 | Aljabri | H04N 1/32352 |
| 2005/0139681 | A1 | 6/2005 | Premjeyanth et al. | |
| 2006/0213986 | A1 * | 9/2006 | Register, Jr. | G06K 19/04 235/382.5 |
| 2008/0012699 | A1 * | 1/2008 | Crowley | G01T 1/167 340/521 |
| 2009/0152356 | A1 | 6/2009 | Reddy et al. | |
| 2009/0322866 | A1 * | 12/2009 | Stotz | G07C 9/00087 348/77 |
| 2010/0073128 | A1 | 3/2010 | Talwerdi | |
| 2010/0270510 | A1 | 10/2010 | Krietsch et al. | |
| 2010/0308108 | A1 | 12/2010 | Choi et al. | |
| 2013/0082105 | A1 | 4/2013 | Schützmann et al. | |
| 2014/0291495 | A1 | 10/2014 | Fischer et al. | |
| 2015/0088775 | A1 * | 3/2015 | McIntire | G06Q 50/265 705/325 |

FOREIGN PATENT DOCUMENTS

| | | |
|---|---|---|
| EP | 1046692 | 10/2000 |
| EP | 1213338 | 6/2002 |
| EP | 1236181 | 9/2002 |
| EP | 1131769 | 2/2005 |
| EP | 2402401 | 1/2012 |
| EP | 2220171 | 3/2014 |
| WO | 2000070536 | 11/2000 |
| WO | 2001024106 | 4/2001 |
| WO | 2002073250 | 9/2002 |
| WO | 2003000801 | 1/2003 |
| WO | 2004097716 | 11/2004 |
| WO | 2006063926 | 6/2006 |
| WO | 2007060133 | 5/2007 |
| WO | 2007131833 | 11/2007 |
| WO | 2008083894 | 7/2008 |
| WO | 2009121605 | 10/2009 |
| WO | 2012001077 | 1/2012 |
| WO | 2013045082 | 4/2013 |
| WO | 2013120590 | 8/2013 |
| WO | 2013135339 | 9/2013 |
| WO | 2013159862 | 10/2013 |
| WO | 2013159863 | 10/2013 |
| WO | 2014180840 | 11/2014 |

OTHER PUBLICATIONS

Colorimetry—Part 4: CIE 1976 L *a*b* Colour space, CIELAB (1976) system, 17 pgs.
International Standard, Magnetic materials—Part 1: Classification, IEC60404-1 (2000), 118 pgs.
International Search Report and Written Opinion issued with respect to application No. PCT/EP2016/051803, (2016).

* cited by examiner 200
202
204
Name
Example
First Name
Jane
Date of birth
01.01.1990
Sex
F
Date of emission
02.02.2010
Date of expiration
01.02.2020
Profession
Doctor
Signature
P<JANEXAMPLEF<<<MINU<<

SIMULTANEOUS AUTHENTICATION OF A SECURITY ARTICLE AND IDENTIFICATION OF THE SECURITY ARTICLE USER

FIELD OF THE INVENTION

The present invention relates to security checkpoint for authenticating a security article and a method for operating a security checkpoint. More particularly, the present invention relates to any one of determining whether a security article is genuine, determining whether a user of a security article is authorized, and/or identifying such a user. The present invention also relates to border or checkpoint control.

BACKGROUND OF THE INVENTION

Security checkpoints permit authorities, such as governments or private enterprises, to verify an individual's identity and other credentials of the individual prior to permitting that individual into a particular area. Security checkpoints can be found at borders, such as borders between countries and borders around restricted areas within countries and other exclusion zones; transportation hubs (such as airports), military or other security sensitive areas and zones, train stations, bus stations, ports and shipping dockyards, hospitals, judiciary courts, buildings and vaults for computer servers or datacenters, police stations, laboratories; event venues such as stadiums and concert halls; at and within buildings such as office buildings, political institutions and research facilities; construction sites, banks, hotels; and other places where it is desired to confirm the validity of a security article permitting access and the identity of an individual or whether an individual is permitted to access a particular area.

Security articles are usually protected by several layers of different security elements or features, which are chosen from different technology fields, manufactured by different suppliers, and embodied in different constituting parts of the security article. To break the protection of the security article, the counterfeiter would need to obtain all of the implied materials and to get access to all of the required processing technology, which is a hardly achievable task. Security features, e.g. for security articles, can generally be classified into "covert" security features and "overt" security features. The protection provided by "covert" security features relies on the concept that such features require specialized equipment and knowledge for detection, whereas "overt" security features rely on the concept of being detectable with the unaided human senses.

Currently used apparatuses and methods for authenticating a security article and identifying a user of said article, so as to assess if the security article is genuine and if the user is the authorized user of said article, exhibit several shortcomings. They are in particular slow, time consuming, expensive, complex, require human interventions and expensive personnel, and can sometimes fail in the assessment of the genuineness of the security article and in the identification of the user.

It is therefore an object of the present invention to provide an apparatus and a method for authenticating a security article so as to assess whether the security article is genuine and, whether the user is an authorized user of the security article. Preferably, the apparatus and method are improved with regard to one or more of safety, reliability, speed, cost, ease of operation, and automation.

SUMMARY OF THE INVENTION

The mentioned objects and problems are solved by the subject-matter of any independent claim. Further preferred embodiments are defined by the dependent claims.

According to one embodiment of the present invention, there is provided a security checkpoint for authenticating a security article, the security checkpoint comprising a biographic information capturing device configured to capture biographic information from the security article; a security feature detector configured to detect a physical property of a security feature on and/or in the security article; and a gate moveable between a closed position and an open position; wherein the captured biographic information and the detected physical property of the security feature on and/or in the security article are processed to determine whether the security article is genuine, and the gate is operable to be moved from the closed to the open position depending on the determination.

Preferably, the security checkpoint described herein further comprises a biometric data capturing device configured to capture biometric data from a security article user, wherein the captured biometric data is compared with the captured biographic information to at least partially determine whether the security article user is an authorized user of the security article.

Preferably, the security checkpoint described herein further comprises a processor configured to perform the processing of the captured biographic information and the detected physical property and the determining of whether the security article is genuine.

In some embodiments, the security feature detector described herein comprises at least one of a magnetic detector, a conductivity meter, and an optical detector. In some embodiments, the apparatus described herein further comprises a stimulus device configured to activate the physical property of the security feature.

In some embodiments, the security checkpoint described herein further comprises a localization device for identifying the location of the security checkpoint or a related apparatus, which, optionally, is operable to produce an alarm signal if the location of the apparatus is not within a pre-defined location and/or to disable the apparatus if the apparatus is removed from the pre-defined location.

In some embodiments, the biographic information capturing device comprises at least one of a camera, an optical scanner and an electronic data capturing device. Preferably, the electronic data capturing device comprises a wireless device configured to wirelessly capture the biographic information from an electronic storage device attached to the security article.

In some embodiments, the security checkpoint described herein further comprises a security article receiving device adapted to receive the security article and to capture from the security article the biographic information and the physical property of the security feature.

According to further embodiments of the present invention, it is also provided a use of such a security checkpoint or method for authenticating a security article and authenticating and/or identifying an authorized user of said security article.

According to another embodiment of the present invention, there is provided a method for operating a security checkpoint and for authenticating a security article, comprising the steps of capturing biographic information from the security article; detecting a physical property of a security feature on and/or in the security article; processing the captured biographic information and the detected physical property on and/or in the security article to determine whether the security article is genuine; and operating a gate, moveable between a closed position, to be moved from the closed to the open position depending on the determination.

Preferably, the step of detecting the physical property comprises detecting at least one of a magnetic property of the security feature, an electrical property of the security feature, and an optical property of the security feature. More preferably, detecting the optical property comprises detecting at least one of light intensity of emitted, reflected or absorbed light, light emission wavelength, reflection wavelength, absorption wavelength and light polarization.

In some embodiments, the method further comprises a step of capturing biometric data from a security article user, and a step of comparing the captured biometric data with the captured biographic information to at least partially determine whether the security article user is an authorized user of the security article.

In some embodiments, the method further comprises activating the physical property by subjecting the security feature to an external stimulus.

In some embodiments, the biographic information is captured by at least one of optically scanning the security article, capturing an image of the security article, and capturing electronic data from an electronic memory device attached to the security article.

BRIEF DESCRIPTION OF DRAWINGS

Embodiments of the present invention are further described in the detailed description which follows, with reference to one or more of the accompanying figures, by way of non-limiting examples of embodiments of the present invention, in which like characters represent like elements throughout the several views of the figures.

More specifically, examples of an apparatus for authenticating a security article, a security checkpoint, and methods of operation will now be described with reference to the accompanying figures, in which.

DETAILED DESCRIPTION

Definitions

Figure 1:
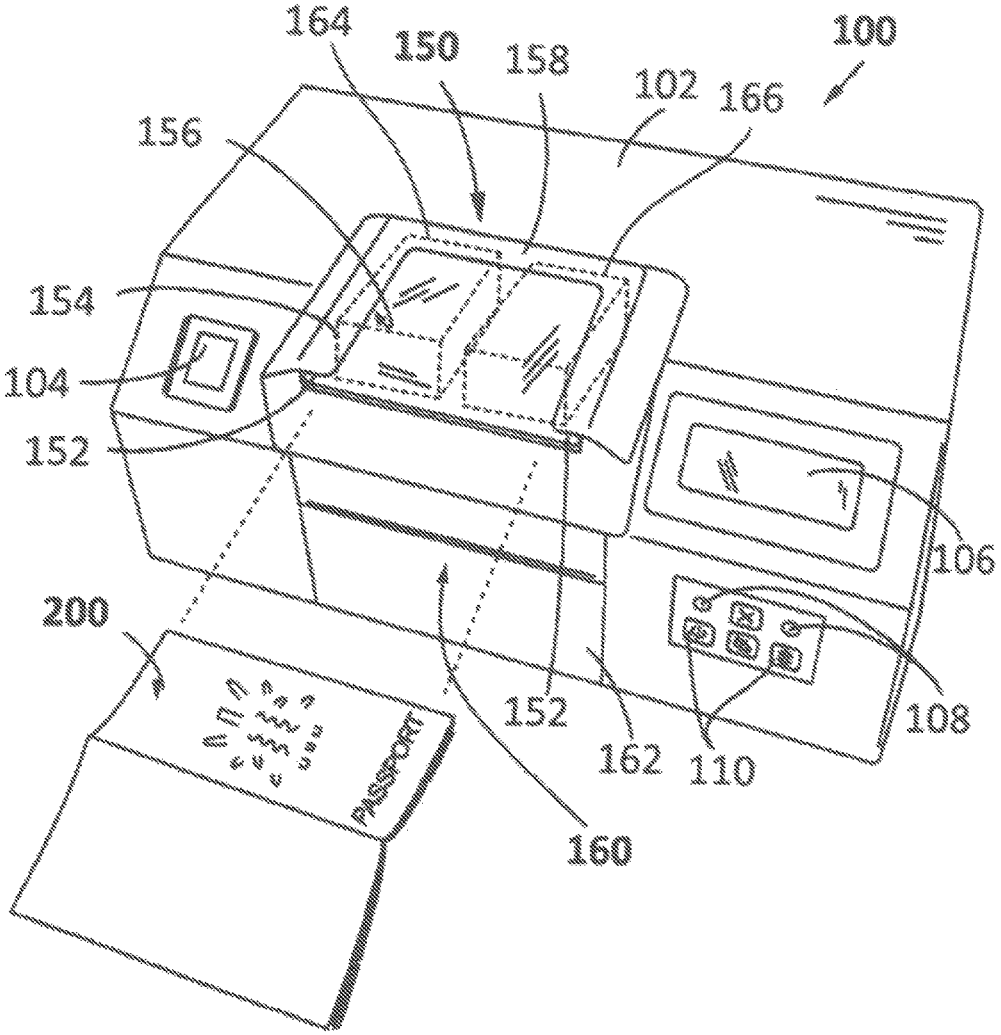
FIG. 1 shows a schematic view of an apparatus for authenticating a security article used in a security checkpoint according to an embodiment of the present invention.

The following definitions are to be used to interpret the meaning of the terms discussed in the description and recited in the claims.

As used herein, the indefinite article "a" indicates one as well as more than one and does not necessarily limit its referent noun to the singular.

As used herein, the term "about" means that the amount or value in question may be the specific value designated or some other value in its neighborhood. Generally, the term "about" denoting a certain value is intended to denote a range within ±5% of the value. As one example, the phrase "about 100" denotes a range of 100±5, i.e. the range from 95 to 105. Generally, when the term "about" is used, it can be expected that similar results or effects according to the invention can be obtained within a range of ±5% of the indicated value.

As used herein, the term "and/or" means that either all or only one of the elements of said group may be present. For example, "A and/or B" shall mean "only A, or only B, or both A and B". In the case of "only A", the term also covers the possibility that B is absent, i.e. "only A, but not B".

The term "comprising" as used herein is intended to be non-exclusive and open-ended. Thus, for instance a coating composition comprising a compound A may include other compounds besides A. However, the term "comprising" also covers the more restrictive meanings of "consisting essentially of" and "consisting of", so that for instance "a coating composition comprising a compound A" may also (essentially) consist of the compound A.

The term "security feature" is used to denote generally an element that can be used for authentication purposes. In this way, a "security feature" can be a form of an image or a graphic element.

As used herein, the term "security article" refers to an article which is usually protected against counterfeit or fraud by at least one security feature.

As used herein, the term "security article user" is used to denote an individual to be identified at the apparatus (disclosed in the present invention) location and to be authorized to advance beyond the apparatus location or beyond a security checkpoint or an electronic gate disclosed in the present invention. As used herein, the term "security officer" is used to denote an individual in charge of using the apparatus disclosed in the present invention to identify a security article user. As used herein, the term "maintenance person" is used to denote an individual in charge of the maintenance and repairing of the apparatus disclosed in the present invention.

As used herein, the term "biographic information" is used to denote information related to the personal life of a security article user, of a security officer or of a maintenance person.

As used herein, the term "biometric data" is used to denote a physical characteristic of a security article user, a security officer or a maintenance person.

As used herein, the terms "sensors" and "detectors" refer to any device, component, or equipment that senses or detects any desired observable.

The term "ultraviolet" (UV) is used to designate wavelengths which are shorter than 400 nm. The term "visible" (VIS) is used to designate the spectral range between 400 nm and 700 nm. The expression "infrared" (IR) is used to designate the spectral range between 700 nm and 10000 nm wavelength, preferably between 700 and 2500 nm.

Detailed Description of the Invention

The present disclosure, through one or more of its various aspects, embodiments and/or specific features or sub-components, is intended to bring out one or more of the advantages as specifically noted below. The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice. As should be understood, at least some of the exemplary schematic representations are not necessarily drawn to scale in order to more clearly illustrate aspects of the present invention.

Any descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiments were chosen and described in order to best explain the principles of the present invention and its practical application, to thereby enable others skilled in the art to best utilize the present invention and various embodiments with various modifications as are suited to the particular use contemplated.

The embodiments of the present invention generally relate to authentication of or authenticating a security article. Likewise, the embodiments of the present invention generally relate to identification of or identifying an individual, who may be a security article user, a security officer or a maintenance person.

The present invention provides a security checkpoint and a method for operating a security checkpoint including authenticating the security article described herein by checking the genuineness of the security feature present on and/or in said security article.

The security article includes documents of various sizes, documents having specific known dimensions, bound documents, booklet-type documents, unbound documents, sheet-like documents, single-sheet documents, card-like documents and cards. Typical example of security articles include without limitation passports, identity cards, visas, driving licenses, company employee's identification badges, financial transaction cards such as for example bank cards, credit cards and transaction cards, access documents or cards, entrance tickets, public transportation tickets or titles, birth certificates, health cards permitting an individual to obtain medical services, and the likes.

A security article user is generally an individual selected from, for example and without limitation, travelers, vehicle drivers, people attending an event, people working or visiting a secured or restricted areas or event, and the like.

The security features present on and/or in the security article described herein may be a covert security feature, an overt security feature or an overt and covert security feature. The security feature present on and/or in the security article described herein may consist of a serial number; a printed text, a printed pattern, a designs or code made of a security ink; an intaglio printed pattern or design; a security thread or stripe; a window; fibers; planchettes; a foil; a decal; an hologram; microprintings; a 3-D security ribbon; and/or watermarks. The printed text described herein may be the biographic information or part of it, the biometric data or part of it and/or the machine readable zone (MRZ) or part of it. The security features present on and/or in the security article described herein are machine readable security feature. As used herein, the term "machine readable security feature" refers to a security feature which exhibits at least one distinctive physical property which may be measured with the use of a security feature detector. Machine readable security features comprise at least one machine readable substance, wherein said machine readable substance refers to a material that bears information which may be measured when using a security feature detector and which can be admixed to or comprised in an ink or composition so as to confer a way to authenticate said ink/composition or article comprising said ink/composition by the use of the particular security feature detector for its authentication. In general, however, the physical property of the security feature described herein may be selected from the group consisting of optical properties, magnetic properties, conductivity properties and combinations thereof.

According to further embodiments, the security feature described herein is a pattern representing a code selected from the group consisting of special characters, series of alphanumerical characters and combinations thereof. Alternatively, the security feature described herein is a 1-dimensional barcode, a stacked 1-dimensional barcode, a 2-dimensional barcode (such as a DataMatrix or a QR-Code) or a 3-dimensional barcode. Such a code may comprise additional or redundant information in an encoded form so that it is generally not readable or understandable without a key or a procedure to decode the encoded information. When the security feature described herein is a pattern representing a code, said pattern is preferably invisible to the naked eye.

In some embodiments, the physical property of the security feature described herein consists of an optical property. Optical properties of the security feature described herein refers to any spectrally selective return of light (electromagnetic radiation) at a predetermined color (predetermined wavelength) from an illuminated object, be it in the visible, the infrared or in the UV range of the electromagnetic spectrum (i.e. in the whole wavelength range from 200 nm to 2500 nm). The optical property is preferably selected from the group consisting of intensities of reflected light, reflection wavelengths, optically variable properties, intensities of IR absorbed light, IR absorption wavelengths, intensities of emitted light, emission wavelengths, light polarizations and combinations thereof. Further, optical properties of the security feature described herein may be preferably selected from the group consisting of optically variable characteristics, IR absorption characteristics, emission characteristics, light polarization characteristics and combinations thereof.

Optically variable elements are known in the field of security printing. Optically variable elements (also referred in the art as goniochromatic elements or colorshifting elements) exhibit a viewing-angle or incidence-angle dependent color, and are used to protect security articles against counterfeiting and/or illegal reproduction by commonly available color scanning, printing and copying office equipment. The optically variable characteristic impart a different color impression at different viewing angles By "different color impression", it is meant that the element exhibits a difference of at least one parameter of the CIELAB (1976) system, preferably exhibits a different "a*" value, a different "L*" value or a different "b*" value or exhibits two or three different values chosen among "a*", "b*" and "L*"values at different viewing angles. On the contrary to optically variable features that exhibit different colors or color impressions upon variation of the viewing angle, color constant features consist of features that do not exhibit a color change or color impression change upon variation of the viewing angle. Typical examples of optically variable security features consist of optically variable patterns such as for example cholesteric liquid crystal polymer coating or may consist of printed pattern made of an optically variable ink, said optically variable ink comprising optically variable pigments such as for example thin film interference pigments, interference coated pigments, cholesteric liquid crystal pigments or mixtures thereof.

Thin-film interference pigments exhibiting optically variable characteristics are known to those skilled in the art and disclosed in U.S. Pat. Nos. 4,705,300; 4,705,356; 4,721,271; 5,084,351; 5,214,530; 5,281,480; 5,383,995; 5,569,535, 5,571624 and in the documents related to these. Thin film interference pigments comprising a Fabry-Perot reflector/dielectric/absorber multilayer structure and more preferably a Fabry-Perot absorber/dielectric/reflector/dielectric/absorber multilayer structure, wherein the absorber layers are partially transmitting and partially reflecting, the dielectric layers are transmitting and the reflective layer is reflecting the incoming light are particularly used in the field of security.

Interference coated pigments include without limitation structures consisting of a material selected from the group consisting of metallic cores such as titanium, silver, aluminum, copper, chromium, germanium, molybdenum or tantalum coated with one or more layers made of metal oxides as well as structures consisting of a core made of synthetic or natural micas, other layered silicates (e.g. talc, kaolin and sericite), glasses (e.g. borosilicates), silicium dioxides ($SiO_2$), aluminum oxides ($Al_2O_3$), titanium oxides ($TiO_2$), graphites and mixtures thereof coated with one or more layers made of metal oxides (e.g. titanium oxides, zirconium oxides, tin oxides, chromium oxides, nickel oxides and copper oxides), the structures described hereabove have been described for example in Chem. Rev. 99 (1999), G. Pfaff and P. Reynders, pages 1963-1981 and WO 2008/083894.

Liquid crystals in the cholesteric phase exhibit a molecular order in the form of a helical superstructure perpendicular to the longitudinal axes of its molecules. The helical superstructure is at the origin of a periodic refractive index modulation throughout the liquid crystal material, which in turn results in a selective transmission/reflection of determined wavelengths of light (interference filter effect). Cholesteric liquid crystal polymers can be obtained by subjecting one or more crosslinkable substances (nematic compounds) with a chiral phase to alignment and orientation. The pitch (i.e. the distance over which a full rotation of 360° of the helical arrangement is completed) can be tuned in particular by varying selectable factors including the temperature and solvents concentration, by changing the nature of the chiral component(s) and the ratio of nematic and chiral compounds. Crosslinking under the influence of UV radiation freezes the pitch in a predetermined state by fixing the desired helical form so that the color of the resulting cholesteric liquid crystal materials is no longer depending on external factors such as the temperature.

Cholesteric liquid crystal materials may then be shaped to cholesteric liquid crystal pigments by subsequently comminuting the polymer to the desired particle size. Examples of coatings, films and pigments made from cholesteric liquid crystal materials and their preparation are disclosed in U.S. Pat. Nos. 5,211,877; 5,362,315 and 6,423,246 and in EP 1 213 338 A1; EP 1 046 692 A1 and EP 0 601 483 A1, the respective disclosure of which is incorporated by reference herein.

It should be noted that the optically variable characteristics of the optically variable security features described herein are not limited to the visible range of the electromagnetic spectrum. For example, the optically variable security features may exhibit, at least one viewing angle, a different position of the selective reflection band and/or a different CIE (1976) color index parameter in the visible, IR (infrared) or UV (ultraviolet) ranges and/or colorshifting properties from the visible range to the IR range, or from the UV range to the visible range, or from the UV range to the IR range.

Machine authentication of an optically variable security feature may be performed by illuminating said optically variable security feature so as to form a first light reflected and/or refracted by the security feature at a first view angle and a second light reflected and/or refracted by the security feature at a second view angle, the first and second lights having different spectral compositions as a result of the optically variable security feature, capturing the first light and the second reflected and/or refracted light and comparing the two reflected and/or refracted lights/colors perceived with two reference colors. Examples of such detectors can be found in WO 2004/097716 A1, WO 2012/001077 A1 and WO 2013/045082 A1.

Generally, the security feature detector of at least some embodiments of the present invention may be implemented in line with or similar to the following descriptions. Firstly, WO 2004/097716 A1 discloses a suitable security feature detector to detect a physical property of an optically variable security feature. WO 2004/097716 A1 discloses a device comprising at least two light sources having different spectral characteristics for providing sequential illumination to the optically variable security feature; at least two photodetectors with optional collection optics for collecting light reflected by said security feature at least at two predefined and different observation angles and delivering an electric signal corresponding to the collected light intensity; analog-to-digital converting, processing, controlling and memory means, for controlling the light sources, digitizing and storing reflected intensity values, for comparing said intensity values with previously stored corresponding reference values, and for deriving an authenticity indicator from the comparison result, all according to a predefined algorithm and using a pre-established decision criterion; characterized in that the device comprises a wide-angle illumination optics for guiding the light of said light sources to said security feature.

WO 2012/001077 A1 discloses a suitable security feature detector to detect a physical property of an optically variable security feature. WO 2012/001077 A1 discloses a device including a) a light source configured to illuminate the optically variable security feature so as to form a first light reflected by the security feature at a first view angle and a second light reflected by the security feature at a second view angle, the first and second lights having different spectral compositions as a result of the optically variable marking; b) a prism that refracts said second reflected light so as to redirect said second reflected light; c) an optical sensor that captures the first light and the second refracted light simultaneously; and d) a processing unit that determines optical properties of said optical variable security feature based on said captured first light and the second refracted light. WO 2013/045082 A1 discloses a suitable security feature detector to detect a physical property of an optically variable security feature, said device comprising a plate of light-refractive material, said plate having two surfaces and an array of light-refracting protrusions or recesses on at least one of said surfaces, and being disposed in said device such as to provide, aside each other, a direct view and a view through said plate onto at least parts of said optically variable security feature, said view through said plate being an angularly deflected view, resulting from light refraction at said protrusions or recesses.

Security features based on emission characteristics are known in the art as luminescent materials. Luminescent materials are widely used as marking materials in security applications. Luminescent materials may be inorganic (inorganic host crystals or glasses doped with luminescent ions), organic or organometallic (complexes of luminescent ion(s) with organic ligand(s)) substances. Luminescent materials can absorb certain types of energy in the electromagnetic spectrum, i.e. UV, VIS, and IR range, acting upon them and subsequently emit at least partially this absorbed energy as electromagnetic radiation. Luminescent materials are detected by exposing with a certain wavelength of light and analyzing the emitted light. Down-converting luminescent materials absorb electromagnetic radiation at a higher frequency (shorter wavelength) and at least partially re-emit it at a lower frequency (longer wavelength). Up-converting luminescent materials absorb electromagnetic radiation at a lower frequency and at least partially re-emit part of it at a higher frequency. Light emission of luminescent materials arises from excited states in atoms or molecules. Luminescent materials may be divided in: (i) phosphorescent materials wherein a time-delayed radiation emission is observable after the excitation radiation is removed (typically, with a decay lifetime from above about 1 μs to about 100 s), and (ii) fluorescent materials wherein a prompt radiation emission upon excitation is observable (typically, with a decay lifetime below 1 μs). Both fluorescent and phosphorescent compounds are suitable for the realization of machine readable security feature. In the case of phosphorescent compounds, measurement of decay characteristics may also be carried out and used as a machine readable feature.

Security feature detectors to detect a physical property of a luminescent security feature may comprise a light source to illuminate the luminescent security feature with excitation light and a light sensor (also referred in the art as photodetector) for measuring the luminescence intensity versus the background radiation intensity. A phase detector may be used for the suppression of background signals. Depending on the part of the spectrum used for the detection of the luminescent material, the light source may be an incandescent lamp, typically for wavelengths between about 400 nm to about 2500 nm, used with mechanical or opto-electronic devices for delivering pulsed light, or a flash lamp (e.g. a Xenon high-pressure flash lamp), or a laser or Light-Emitting-Diode (LED), emitting in the UV, visible or IR region, typically for wavelengths from about 250 nm to about 1000 nm. The light source may be powered by a drive current (for a LED for example) or by a drive voltage (for a discharge lamp, for example). The light sensors or photodetectors may be photodiodes (single or arrays), phototransistor or photoresistance circuits, linear CMOS or CCD sensors, for example.

Security features comprising infrared (IR) absorbing materials are widely known and used in security applications. They are based on the absorption of electromagnetic radiation due to electronic transitions in a spectral range between about 700 nm and about 2500 nm, as defined here above. In the domain of machine authentication of security documents, a range of 700 nm to 1500 nm is preferred, and a range of 800 nm to 1000 nm is particularly preferred. For example, IR absorbing features have been implemented in banknotes for use by automatic currency processing equipment, in banking and vending applications (automatic teller machines, automatic vending machines, etc.), in order to recognize a determined currency bill and to verify its authenticity, in particular to discriminate it from replicas made by color copiers. IR absorbing materials include inorganic materials, glasses comprising substantial amounts of IR-absorbing atoms or ions or entities which display IR-absorption as a cooperative effect, IR absorbing organic compounds and IR absorbing organometallic compounds (complexes of cation(s) with organic ligand(s), wherein either the separate cation and/or the separate ligand, or both in conjunction, have IR-absorbing properties). Typical examples of IR absorbing compounds include among others carbon black, quinone-diimmonium or aminium salts, polymethines (e.g. cyanines, squaraines, croconaines), phthalocyanine or naphthalocyanine type (IR-absorbing pi-system), dithiolenes, quaterrylene diimides, metal (such as for example transition metal or lanthanide) salts (such as for example fluorides, chlorides, bromides, iodides, nitrates, nitrites, sulfites, sulfates, phosphates, carbonates, borates, benzoates, acetates, chromates, hexaborides, molybdates, manganates, ferrates, organosulfates, organosulfonates, organophosphonates, organophosphates and phosphonotungstanates), metal oxides (such as for example indium tin oxide, antimony tin oxide in nano-particulate form, doped tin(IV) oxide, cooperative property of the $SnO_4$ crystal), metal nitrides. IR absorbing compounds comprising a transition element compound and whose infrared absorption is a consequence of electronic transitions within the d-shell of transition element atoms or ions such as those described in WO 2007/060133 A2 may also be used for the present invention.

Machine authentication of security features comprising one or more IR absorbing compounds may be performed by using an IR authenticating device comprising one or more IR sources, one or more IR detectors, an analog-to-digital converter and a processor. The security feature comprising the one or more IR absorbing compounds is illuminated by the one or more IR sources, simultaneously or subsequently, the one or more IR detectors detect a signal corresponding to the intensity of light reflected by said security feature, the analog-to-digital converter converts said signal into a digital information that is compared by the processor to a reference stored in a database. The IR authenticating device then outputs a positive signal (meaning that the security feature is genuine) or a negative signal (meaning that the security feature is fake). Optionally, the IR authenticating device may comprise one or more light diffusing elements (like a condenser), one or more lens assemblies (like focusing or collimating lenses), one or more reflecting elements (like mirrors, especially semi-transparent mirrors), one or more light dispersing or diffracting elements (like a prism, a hologram or a grating) and one or more optical filters. In an arrangement, the IR light source illuminates the security feature comprising the one or more IR absorbing compounds at a given angle through a diffuser or a condenser, and the IR detector receives the reflected light through a collimating lens assembly at the same angle. The optional prism, hologram or grating may be placed either between the IR source and the security feature to illuminate said security feature with monochromatic radiation, or between said security feature and said detector to provide said detector with monochromatic reflected light.

In another arrangement (described in WO 00/070536 A1), the IR light is emitted through a focusing lens assembly and deflected to the security feature by a semi-transparent mirror, the illumination direction being substantially perpendicular to said security feature. The light that is reflected away from the security device is collimated, in a direction that is also substantially perpendicular to said security feature, by a second lens assembly and directed towards a prism or a hologram to generate a spectrum. Finally, the generated spectrum is focused with a third lens assembly towards a detector assembly comprising a plurality of IR detectors, each sensitive to a different and limited range of the IR region of the electromagnetic spectrum.

Depending on the region of the electromagnetic spectrum that is used, the IR source may comprise one or more IR LED's (in particular GaAs and AlGaAs), one or more semiconductor laser diodes (in particular InGaAsP), one or more incandescent (like tungsten) lamps, one or more halogen lamps, one or more thermal emitters (nichrome), one or more xenon lamps or a combination thereof. For the machine authentication of a security feature comprising one or more IR absorbing compounds, the preferred IR sources are GaAs and AlGaAs LED's, as well as InGaAsP laser diodes. The IR detector is selected from the group consisting of photomultipliers, thermal detectors and quantum detectors. For the machine authentication of IR absorbing compounds, quantum detectors are preferred. This category includes photovoltaic detectors like Ge (800 to 1800 nm) or InGaAs (700 to 1700 nm), photoconductive detectors like PbS (1000 to 3600 nm) or PbSe (1500 to 5800 nm) and CCD or CMOS sensors (400-1000 nm). Particularly preferred are Ge or InGaAs detectors that are sensitive to a narrow band of IR light (i.e. "selective wavelength" detectors) that can be disposed as an array, thus yielding a spectrum of the intensity of the reflected light as a function of the wavelength. The advantage of CCD and CMOS sensors is that they can be provided as linear sensors or as two-dimensional sensors, said two-dimensional sensors being able to provide an image of the security feature comprising the one or more IR absorbing compounds. In any case, the response provided by the detector, being either the intensity of the reflected light at one or more wavelengths upon a single point illumination or a whole image of said security feature, is compared with a reference to output a positive or negative signal.

The security feature comprising the one or more IR absorbing compounds may consist of a pattern, an image, a logo, a text, a number, or a code (like a bar code or a QR-code). The security feature may be made of a coating composition comprising the one or more IR absorbing compounds, or may be made of a first part that comprises the one or more IR absorbing compounds and a second part that comprises one or more compounds absorbing in another region of the electromagnetic spectrum (UV or visible). When said second part comprises compounds absorbing in the visible region of the electromagnetic spectrum, the security feature may be conceived in such a way that the first and second parts build an image, both parts being made of coating compositions that are color matched in the visible spectrum. Thus, both parts are essentially indistinguishable to the human eye. Said first and second parts may be adjacent to each other, overlapping each other or spaced apart. In such a case, the authenticating device may comprise one or more sources emitting in the visible part of the spectrum (for example red and/or green LED's) and one or more sources emitting in the IR part of the spectrum (for example one or more GaAs LED's with selective wavelengths), the detector being a CMOS or a CCD sensor. Optionally, the authenticating device may be completed by UV sources (like UV LED's), like in US 2005/0139681. Said security feature is then sequentially illuminated by the one or more visible sources, by the one or more IR sources and by the one or more optional UV sources, and the CMOS or CCD sensor takes a picture of the security feature under each illumination. This provides a set of images than can be used separately or combined in any way, the separate pictures or the combination pictures being then compared to reference images stored in a database.

It is possible to achieve in this way a particularly high quality of the output positive or negative signal. This is for example described in WO 01/024106 A1, wherein three different light sources (UV, VIS, IR) are used to illuminate, in a sequential way, a two-dimensional barcode printed with three different coating compositions, each comprising compounds absorbing in each of the three regions. The image of the two-dimensional barcode corresponding to each of the three regions is sequentially taken by a sensor (like a CCD or a CMOS sensor), and these images are then combined to generated a multi-dimensional barcode comprising the information relative to each of the three regions. Alternatively, a custom sensor may be designed with filters, at the pixel level, sensitive to each of the three regions, so that the two-dimensional barcode may be illuminated substantially simultaneously with the three different light sources and the multi-dimensional barcode may be generated in one illumination.

Examples of security features based on light polarization characteristics include cholesteric liquid crystal materials. As mentioned hereabove, liquid crystals in the cholesteric phase exhibit a molecular order in the form of a helical superstructure perpendicular to the longitudinal axes of its molecules. The particular situation of the helical molecular arrangement leads to cholesteric liquid crystal materials exhibiting the property of dispersing unpolarized incident light into components with different polarization, i.e. the reflected light to be left-hand or right-hand circularly polarized depending on the sense of rotation of the helices. Since the human eye is unable to detect the polarization state of the light it is receiving, such as the circular polarization effect of cholesteric liquid crystal materials, the difference in handedness can be detected by machine testing by measuring the polarization of the light reflected from the cholesteric liquid crystal material.

Security feature detectors to detect handiness of a cholesteric liquid crystal material based security feature may comprise one or more lighting sources and one or more receivers comprising one or more polarization-selective elements. The one or more light sources may be chosen from ambient light, incandescent light, laser diodes, light emitting diodes, and all type of light sources having color filters. The one or more polarization-selective elements may be passive means such as for example polarization filters, i.e. left-handed or right-handed circular polarizing filters, or a juxtaposition of both. This allows determining the rotation sense of the helical pitch of the cholesteric liquid crystal material by determining the polarization state of the light reflected by said material. Alternatively, authentication of a cholesteric liquid crystal material based security feature may be performed with the use of circular polarized light from at least one polarized light source.

Alternatively, authentication of a cholesteric liquid crystal material based security feature may be performed with the use of an electro-optical authentication device, said device either comprising at least one photocell in combination with a circular polarization filter and/or with a circular polarized light source or comprising an electro-optic camera, such as a linear CCD sensor array, a 2-dimensional CCD image sensor array, a linear CMOS image sensor array, or a 2-dimensional CMOS image sensor array, in combination with a circular polarization filter and/or with a circular polarized light source. Optionally, the circular polarization filter or the circular polarized light source described hereabove can be combined with color filters, to select a particular spectral domain and to enhance the contrast ratio of the light reflected from the liquid crystal material to the light reflected from the background. Examples of such detectors can be found in U.S. Pat. No. 6,570,648 and WO 2009/121605 A1.

According to further embodiments, the physical property of the security feature described herein consists of a combination of different optical properties such as for example optically variable properties and emission properties as well as optically variable properties and light polarization properties. Typical examples of security features based on optically variable properties and light polarization properties consist of cholesteric liquid crystal materials based security features described here above.

According to further embodiments, the physical property of the security feature described herein consists of magnetic properties. Magnetic materials are widely used as marking materials in security applications to confer to the security article an additional, covert, security element which can be easily sensed by electronic means. Magnetic compounds exhibit particular and detectable magnetic properties of the ferromagnetic or ferrimagnetic type and include permanent magnetic compounds (hard-magnetic compounds with coercivity $H_c$>1000 A/m) and magnetizable compounds (soft-magnetic compounds with coercivity $H_c \leq 1000$ A/m according to IEC60404-1 (2000)). Typical examples of magnetic compounds include iron, nickel, cobalt, manganese and their magnetic alloys, carbonyl iron, chromium dioxide $CrO_2$, magnetic iron oxides (e.g. $Fe_2O_3$; $Fe_3O_4$), magnetic ferrites $M(II)Fe(III)_2O_4$ and hexaferrites $M(II)Fe(III)_{12}O_{19}$, the magnetic garnets $M(III)_3Fe(III)_5O_{12}$ (such as Yttrium iron garnet $Y_3Fe_5O_{12}$) and their magnetic isostructural substitution products and particles with permanent magnetization (e.g. $CoFe_2O_4$). Magnetic materials are noteworthy characterized by the dependence of their magnetic flux density B as a function of the applied external magnetic field H. At low magnetic field H, the magnetic flux density B is roughly proportional to H, i. e. $B=\mu H$ (p being the relative magnetic permeability). A non-linear behavior of the magnetization function B (H) is generally observed at high magnetic fields H, where p eventually becomes equal to one, i. e. upon magnetization saturation. For many magnetic materials, on decreasing the strength of the magnetic field H from the saturation value to zero, B remains at some fixed value $B_r$, called magnetic remanence. To bring B back to zero again, a negative magnetic field $H_c$, called magnetic coercivity, must be applied to the material. This behavior is called magnetic hysteresis, and the B (H) curve, or magnetization characteristics of such a material is called the magnetic hysteresis curve.

Authentication of security features comprising one or more magnetic materials may be performed by using a magnetic detection device (magnetic detector) comprising one or more magnetic sensors, one or more analog-to-digital converters and a processor. Optionally, the magnetic detection device may comprise one or more magnetization units under the form of permanent magnets and/or electromagnets, and one or more amplifiers. The one or more magnetic sensors and the optional one or more magnetization units can be movably mounted on one or more linear guidelines or on one or more cylinders and provided with one or more electric stepping motors (linear or circular). Alternatively, said one or more magnetic sensors and said one or more optional magnetization units can be provided as multiple groups or arrays, each group or array possessing its own linear guideline or cylinder and its own stepping motor (linear or circular) and being able to move independently. The security article carrying the security feature comprising one or more magnetic materials can then be conveyed to the magnetic detection unit through a document-guiding unit. The one or more magnetic sensors and the one or more optional magnetization comprised in said magnetic detection unit move back and forth, when they are mounted on one or more linear guidelines, or circularly, when they are mounted on one or more cylinders, together or as independent groups or arrays, in a selected sequence and at a required speed to detect the information contained within said security feature as a variation of voltage, of resistance or of current, depending on the type of the magnetic sensors being used. The detected information is then sent, after optional amplifying and digital converting, to the processor wherein it is compared with references or threshold values contained in a database. A positive or negative signal is then output.

When the security feature comprises one or more high-coercivity materials (which possess a remanent magnetization), the one or more magnetic sensors measure the intensity of said remanent magnetization. When the security feature comprises one or more low-coercivity materials (which do not have a measurable remanent magnetization and need to be magnetized with an external magnetic field H), the one or more magnetic sensors may measure the variation of the magnetic field H due to the magnetic permeability of the one or more low-coercivity materials. The external magnetic field can be provided by one or more permanent magnets, and/or one or more electromagnets. Advantageously, the one or more permanent magnets and/or the one or more electromagnets are included within the one or more magnetic sensors.

In general, a magnetic sensor is a sensor which serves to detect a magnetic field. Depending on the magnetic material and on specific embodiments of the magnetic detection device, different types of magnetic sensors may be used. Known are for example inductive sensors (comprising coils), fluxgate sensors (comprising a thin ferromagnetic core on which two coils, one for excitation and one for detection, are wound), magnetoresistive sensors, which experience a resistance increase dependent on the applied magnetic field, Hall-effect sensors, in which a voltage dependent on the applied magnetic field is generated, and magneto-optical sensors. Magnetoresistive sensors suitable for the machine detection of magnetic compounds include classical magnetoresistive sensors, anisotropic magnetoresistance sensors (AMR), and giant magnetoresistance sensors (GMR). Usually, the signal generated by passing the security feature comprising the one or more magnetic materials by the one or more magnetic sensors and the one or more optional magnetization units is weak; hence an amplification circuit is needed. Advantageously, and with the aim of limiting the noise induced by the amplification circuit and the associated decrease of the signal-to-noise ratio, each one of the one or more magnetic sensors possesses its own amplification circuit, or, when the one or more magnetic sensors are provided as a group or array, the amplification circuit is coupled with said group or array.

The one or more magnetic materials may be integrated in a coating composition to be printed or coated directly onto the security article, or by printing or coating a thread, a stripe or a foil to be applied to or integrated into the security article. The coating composition may be applied either continuously, building easy to detect plain area, or only in certain areas, for example under the form of a code, an image, a logo, a text or a pattern. When the coating composition is printed as a text, the text may be read using a specific type of magnetic sensors, called magnetic ink character recognition (MICR) sensors, as mentioned in US 2009/152 356 A1.

Additionally to the one or more magnetic materials, said coating composition may comprise colorants or pigments absorbing in the UV, the visible or the IR region of the electromagnetic spectrum. The whole security feature may be made of a coating composition comprising one or more magnetic materials, or of a first part that comprises said one or more magnetic materials, and of a second part that does not contain a magnetic material. The security feature may be conceived in such a way that said first and second parts build an image, both parts being made of coating compositions that are color matched in the visible region of the electromagnetic spectrum. Thus, both parts can be essentially indistinguishable to the human eye, the first part comprising one or more magnetic materials being only detectable using a magnetic detection device as described here above. Said first and second parts may be adjacent to each other, overlapping each other or spaced apart.

Advantageously, the security feature comprising one or more magnetic materials may be made of a plurality of magnetic regions with different magnetic properties, adjacent to each other, overlapping each other or having gaps between them. For example, US 2013/082 105 A1 discloses a method of checking value documents having a security element with a plurality of magnetic areas, which include at least one high-coercivity magnetic region having a high-coercivity magnetic material, one low-coercivity magnetic region having a low-coercivity magnetic material, and optionally a combined magnetic region, which contains both the high-coercivity magnetic material and the low-coercivity magnetic material. All three regions can be reliably distinguished on the basis of their specific magnetic response.

According to further embodiments, the physical property of the security feature described herein consists of a combination of optical properties, in particular optically variable properties and magnetic properties. Typical examples of security features based on optically variable magnetic properties include without limitation magnetic thin film interference materials, magnetic coated pigments and magnetic cholesteric liquid crystal materials. Magnetic thin film interference materials, in particular magnetic thin film interference pigment particles, are known to those skilled in the art and are disclosed e.g. in U.S. Pat. No. 4,838,648; WO 2002/073250 A2; EP 0 686 675 B1; WO 2003/000801 A2; U.S. Pat. No. 6,838,166; WO 2007/131833 A1; EP 2 402 401 A1 and in the documents cited therein. Typical examples of magnetic thin film interference pigment particles comprise pigment particles having a five-layer Fabry-Perot multilayer structure and/or pigment particles having a six-layer Fabry-Perot multilayer structure and/or pigment particles having a seven-layer Fabry-Perot multilayer structure. Five-layer Fabry-Perot multilayer structures consist of absorber/dielectric/reflector/dielectric/absorber multilayer structures wherein the reflector and/or the absorber is also a magnetic layer. Six-layer Fabry-Perot multilayer structures consist of absorber/dielectric/reflector/magnetic/dielectric/absorber multilayer structures. Seven-layer Fabry Perot multilayer structures consist of absorber/dielectric/reflector/magnetic/reflector/dielectric/absorber multilayer structures Magnetic cholesteric liquid crystal pigment particles exhibiting optically variable characteristics include without limitation magnetic monolayered cholesteric liquid crystal pigment particles and magnetic multilayered cholesteric liquid crystal pigment particles. Such pigment particles are disclosed for example in WO 2006/063926 A1, U.S. Pat. Nos. 6,582,781 and 6,531,221. WO 2006/063926 A1 discloses monolayers and pigment particles obtained therefrom with high brilliance and colorshifting properties with additional particular properties such as magnetizability. The disclosed monolayers and pigment particles, which are obtained therefrom by comminuting said monolayers, include a three-dimensionally crosslinked cholesteric liquid crystal mixture and magnetic nanoparticles. U.S. Pat. Nos. 6,582,781 and 6,410,130 disclose platelet-shaped cholesteric multilayer pigment particles which comprise the sequence A1/B/A2, wherein A1 and A2 may be identical or different and each comprises at least one cholesteric layer, and B is an interlayer absorbing all or some of the light transmitted by the layers A1 and A2 and imparting magnetic properties to said interlayer. U.S. Pat. No. 6,531,221 discloses platelet-shaped cholesteric multilayer pigment particles which comprise the sequence A/B and optionally C, wherein A and C are absorbing layers comprising pigment particles imparting magnetic properties, and B is a cholesteric layer.

According to further embodiments, the physical property of the security feature described herein consists of conductivity properties. A security feature comprising one or more conductive materials may be detected by simple detection devices, like electrode circuits that are contacted with said security feature. Advantageously, said detection devices comprise contactless electronic means, such as inductive or capacitive sensors. Capacitive sensors use an electric field oscillating at a high frequency (typically 500 kHz to 1 MHz). Bringing the capacitive sensor towards the security feature comprising the one or more conductive materials changes the capacitance of the sensor, which in turn generates a current flow in the sensor. The sensor electronics produces a calibrated voltage which is proportional to the magnitude of the current flow, thus indicating the presence or the absence of the security feature comprising one or more conductive materials. Inductive sensors use an oscillating magnetic field generated by passing AC current through one or more coils. When said oscillating magnetic field interacts with the security feature comprising one or more conductive materials, an eddy current (also called induced current) is produced, which generates an oscillating magnetic field that opposes the oscillating field of the inductive sensor. This is turn yields a current flow in the inductive sensor, said current flow being transformed into a calibrated voltage by the sensor electronics, as previously described for the capacitive sensor. In the field of security, capacitive sensors are usually preferred because there are able to detect small conductive elements without interacting with the environment (substrate or surrounding hardware). For example, U.S. Pat. No. 5,650,729 describes a conductive strip detector comprising a capacitor defined by an elongate, electrically conductive element and a laterally spaced, electrically conductive member. Monitoring circuitry monitors changes in the capacitance of the capacitor when an electrically conductive strip substantially parallel to the element is passed by the capacitor and indicates when a change in capacitance is due to the presence of an electrically conductive strip.

The security feature may comprise, additionally to the one or more conductive materials, one or more materials that react to induced electric current and/or induced voltage, like an electroluminescent material or an electrochromic material. In this case, the one or more conductive materials of the security feature are detected indirectly, using the light emitted by the luminescent material or the change of color of the electrochromic material.

The conductive materials may be a metal like aluminum, copper, nickel, iron, lead, zinc and tin, and alloys thereof, coated on a polymeric substrate like PET, PVC or BOPP (biaxially oriented polypropylene) under the form of a thread (metallized or partially demetalized), a stripe, a foil or a decal, applied to or embedded into the substrate of the security article. In the simplest form, metallic wires may be processed directly within the substrate (plastic like BOPP, wood pulp or cotton pulp). The one or more conductive materials may also be embedded in a polymeric matrix, as described in US 2014/291495. Said matrix comprises one or more non-conducting, transparent or non-transparent thermoplastic polymers such as PC (polycarbonate, especially bisphenol A polycarbonate), PET (polyethylene terephthalate), PMMA (polymethyl methacrylate), TPU (thermoplastic polyurethane elastomers), PE (polyethylene), PP (polypropylene), PI (polyimide), PVC (polyvinyl chloride), polystyrene, polyacrylates and methacrylates, vinyl esters, ABS and copolymers and/or blends thereof.

The one or more conductive materials embedded in said polymeric matrix are for example metallic nanoparticles, especially silver nanoparticles, pigments surface treated with one or more conductive layers (described for example in U.S. Pat. No. 7,416,688), pigments comprising a conductive core (described for example in EP 2 220 171 B1), conductive mixed oxides like ZnO (zinc oxide), ITO (indium tin oxide) or ATO (antimony tin oxide), and carbon derivatives, like fullerenes, graphenes and carbon nanotubes (especially so-called MWNT, standing for multiwalled nanotubes, that are easier to produce and exhibit a higher conductivity than SWNT, single-walled nanotubes). Advantageously, pigments surface treated with one or more conductive layer are based on inexpensive core materials like titanium oxide, synthetic or natural micas, other phyllosilicates, glasses, silicon dioxides or aluminum oxides, that are enwrapped by the conductive layer. Preferred are pigments surface treated with a conductive layer that exhibit a high aspect ratio, also called leafing pigments, that orient themselves along the direction of coating or printing, thus improving the conductivity of the security feature. Alternatively, highly conjugated polymers may be used as the one or more conductive materials. They can provide the advantages that no polymer matrix is needed, and that they are able to build transparent, flexible layers. Such highly conjugated polymers are for example described in WO 2013/135339 A2, WO 2013/120590 A1, WO 2013/159862 A1 and WO 2013/159863 A1). Preferred highly conjugated polymers are polyaniline, polythiophene (and especially PEDOT/PSS, obtained by copolymerizing 3,4-ethylenedioxythiophene with styrene sulfonate), polyfluorene, polyphenylenevinylene and polypyrrole. Particularly preferred is PEDOT/PSS, which shows good conductivity (close to ITO, indium tin oxide), high transparency, and good flexibility and mechanical resistance. Advantageously, and for reasons previously explained, the security feature comprising the one or more conductive materials may contain one or more luminescent materials. The one or more luminescent materials are selected from the group consisting of luminescent molecules (that are homogeneously dissolved into the polymeric matrix), luminescent pigments (that are dispersed within said polymeric matrix), semi-conductor quantum dots (like CdSe, ZnS, ZnSe, CdZnSe, CdS, InAs, InP, CdSeS), luminescent polymers (extensively described in US 2014/291495) and pigments that are surface-treated with a luminescent layer. Alternatively and/or additionally, the security feature comprising the one or more conductive materials may contain one or more electrochromic materials. The one or more electrochromic materials may be selected from the group consisting of polymeric electrochromic materials, non-polymeric electrochromic materials and blends thereof. A comprehensive list of electrochromic materials may be found in U.S. Pat. No. 8,243,356, which is incorporated herein by reference.

FIG. 1 shows a schematic view of an apparatus 100 for authenticating a security article 200. The apparatus 100 can be used in or be part of a security checkpoint according to an embodiment of the present invention. As an example, the shown apparatus 100 may be provided as part of or in the vicinity of a security checkpoint such as the one described in FIG. 3 or an electronic gate (for example, as part of automatic border control) such as the one described in FIG. 4A. Specifically, in such embodiments, the system of the apparatus 100 is operable to perform reading, verification and/or authentication functions associated with a security checkpoint.

More specifically, FIG. 1 shows an apparatus 100 for authenticating a security article 200 and determining and/or identifying a security article user authorized to carry the security article. In other words, the apparatus 100 is generally operable to read, authenticate, and, optionally, also print on a security article 200. The apparatus 100 according to this embodiment comprises an apparatus housing 102 for housing various components of the involved system and apparatus. The apparatus housing 102 may also accommodate an optional printer system as an output device which is described in greater detail below.

In general, any equipment described herein may be contained in or accommodated by a housing, such as an apparatus housing 102. Specifically, the apparatus housing may accommodate any equipment selected from the group consisting of cameras, audio recorders, proximity detectors, thermal detectors, thermal sensors, tactile sensors, vibration sensors, magnetic energy detectors, ultrasound detectors, ultrasonic transducers, ultrasonic transceivers, motion detectors, document scanners, printers, stamping equipment, speakers, microphones, displays, biographic information capturing devices biometric data capturing devices, output devices, security article receiving devices, security article supports, processors, communication devices, (uninterrupted) power supply equipment, batteries, and combinations thereof. The apparatus housing may be made of any suitable material or material combination, including for example one or more metal(s), e.g. steel, aluminum, titanium; plastics; fiber enforced plastics; ceramics; and the like.

As used herein, the term "biographic information" is used to denote information related to the personal life of a security article user, of a security officer or of a maintenance person. Typical examples of biographic data or biographic information include without limitation name, surname(s), nationality, place or origin, place of birth, date of birth, gender, personal identity number, and personal social number.

Figure 2:
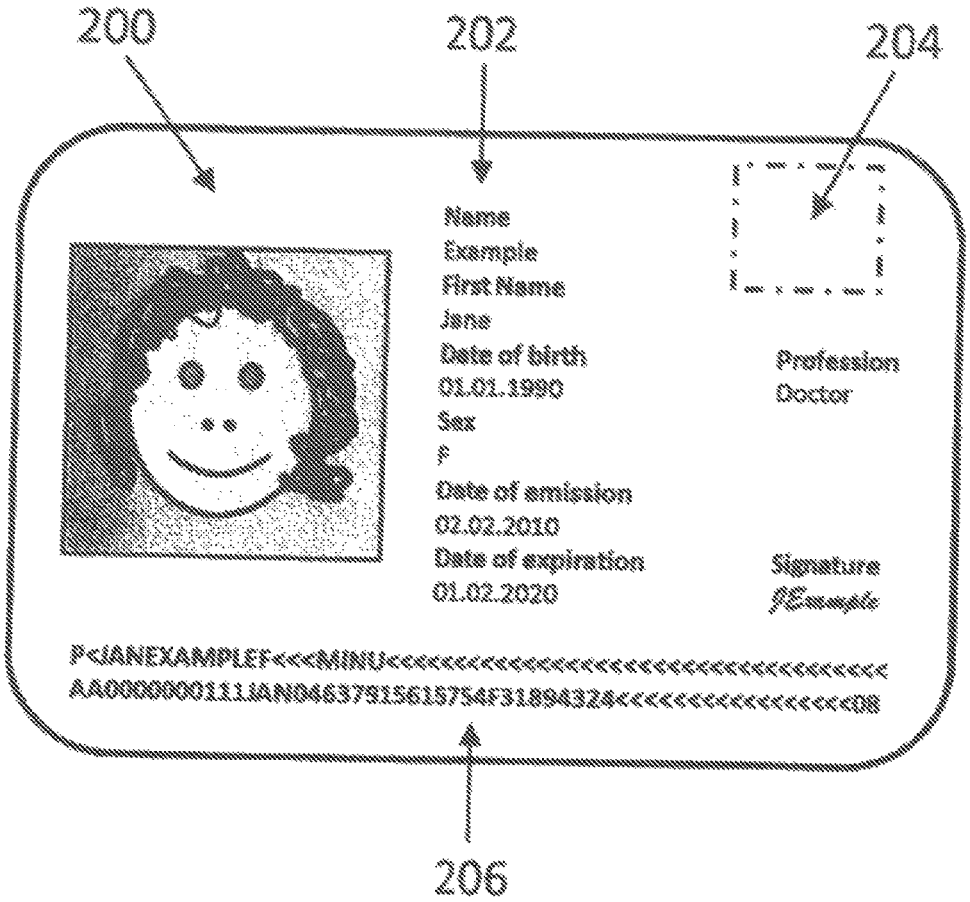
FIG. 2 shows a schematic view of a security article according to an embodiment of the present invention.

FIG. 2 shows a schematic view of a security article 200 according to an embodiment of the present invention. Specifically, in this embodiment the security article is shown as a card or a page of passport, with biographic information 202 and an exemplary security feature 204. In general, embodiments envisage establishing the genuineness of a security article by using security feature detector so as to detect a physical property of a security feature 204 on said security article 200. The physical property described herein may be selected from the group consisting of any properties that are described in conjunction with the present disclosure. For this purpose, the security article 200 comprises a security feature 204, which is machine readable by a security feature detector. The detector which can detect a physical property of said security feature 204, in order to determine whether the security article is genuine. The security article 200 exhibits also biographic information 202, which can be captured by a biographic information capturing device, like a camera or a scanner, in order to determine whether the security article user is an authorized user of the security article. The security article 200 also comprises a machine readable zone (MRZ) 206 as described in greater detail herebelow.

As used herein, the term "biometric data" is used to denote a physical characteristic of a security article user, of a security officer or of a maintenance person. The biometric data may consist of an image or of an alphanumerical description or encoding of the physical characteristic. Typical examples of biometric data include without limitation an image and/or or data corresponding to a biometric data selected from the group consisting of faces, finger prints, palm prints, iris patterns, retina patterns, external ear lobe patterns, vein patterns, blood oxygen levels, bone densities, walking gaits, voices, odor and combinations thereof.

As shown in FIG. 1, the apparatus housing 102 may accommodate a reader support system 150 for supporting a security article during capturing, reading, examination and authentication. The reader support system 150 may include a reader support 152 of substantially planar outer shape (plate-shaped) for supporting the security article 200. The reader support 152 may be at least in part substantially transparent or permeable, so that any desired information or feature from the security article 200 can be read or detected from the security articles by optical, electrical, magnetic and other suitable means. The reader support system 150 may include a receiving flange 154 preferably dimensioned for receiving and guiding the security article.

The receiving flange 154 may define or form a receiving slot 156 which preferably holds the security article 200 so that it can be read in a reliable fashion. The receiving flange 154 may be disposed at the perimeter of the reader support 152. The receiving flange 154 may preferably extend along one or more perimeter sides of the reader support 152, and, preferably, extends along three of four perimeter sides of the reader support 152, so that the security article 200 can be inserted easily and held so that all necessary information can be retrieved (read) through the reader support 152. The receiving flange 154 may also project from the apparatus housing 102, preferably from a top face of apparatus housing 102 or a face of the apparatus housing 102 that can be easily accessed for inserting the security article. Furthermore, the receiving flange 154 may also form part of the apparatus housing 102 or be formed integrally with an outer shell of apparatus housing 102.

The reader support system 150 may include a sensor for detecting the presence of the security article when said security article is inserted into the reader support system 150. Specifically, the reader support system 150 may include a sensor for detecting the presence of the security article 200 when the security article is being received by or inserted into the receiving slot 156 formed by one or more of the receiving flange(s) 154. Said sensor can be preferably disposed within a or in the vicinity of the receiving slot 156 being formed between the reader support 152 and the one or more of the receiving flange(s) 154. The reader support system 150 may also include a plurality of sensors disposed at different perimeter sides of the reader support 152. For example, one or more sensors can be disposed at each of three perimeter sides or respective flanges of the reader support 152.

Said sensor can be implemented in any suitable form, such as a laser, LED, microwave or infrared presence sensor, motion detector, proximity sensor, similar detection sensor, ultra-sound sensor, mechanical sensor, switch or any combination thereof for example. In such embodiments, at least one or more reader sensor is located at a distal end of receiving slot 158 of the reader support 152 so as to indicate when the security article 200 has been fully inserted into the receiving slot 156 as far as the distal end of receiving slot 158. In some embodiments, one or more reader sensors may be located anywhere along the upper receiving flange 154 and/or anywhere around the perimeter of the reader support 152. Some embodiments may include multiple reader sensors spaced apart along the perimeter of the reader support 152 so as to define a grid on the reader support 152, thereby advantageously facilitating identification of the type of security article 200 (e.g. passport, identification card, etc.) being received at the reader support system 150 on the basis of the size of the article being received.

The apparatus may also comprise a security article receiving device adapted to receive the security article 200 and to at least assist in capturing from the security article the biographic information and the physical property of the security feature. The apparatus 100 is thus configured to receive a security article 200 in the exemplary form of the passport booklet for capturing, reading, examination and authentication, such as by receiving the security article, in particular a passport booklet, at the reader support 152 as a security article receiving device. In some embodiment, the apparatus 100 is operable to receive the security article, in particular a passport booklet at the reader support 152. In some embodiments, however, the apparatus 100 may be operable to receive the security article, in particular a passport booklet, from an automated feeder for security articles, including for example sheet feeders and/or booklet feeders either or both of which may be a stacking feeder. In such embodiments, the security article receiving device may generally comprise the means required for receiving the security article, moving, conveying and holding the security article during data and information acquisition, and to eject or release the security article.

The reader support system 150 may further include an imaging device for acquiring images, preferably in the form of digital data. The imaging device is preferably also accommodated by the apparatus housing 102, and may be operable to capture images of the security article when supported by the reader support 152. The imaging device may be operable to capture images of the security article when a light source is producing electromagnetic radiation and illuminates at least a part of supported security article. Preferable implementations of the imaging device include without limitation light sensors, an array thereof, a CCD image sensor, a CMOS image sensor, a camera, a scanner, and the like. In some embodiments, the apparatus 100 may include an enclosure (not shown) for enclosing the reader support system 150. The enclosure may be dimensioned such that the reader system is separate, including possibly being removable, from the remainder of the apparatus housing 102.

The apparatus 100 may further comprise one or more operational elements such as a display 106 in any suitable form that include liquid-crystal displays (LCD), light emitting diode displays (LED displays), organic light emitting diode displays (OLED displays), vacuum fluorescent displays (VFD), and the like. The display 106 may further be configured as a touch-screen display. The apparatus 100 may also be operable to connect to an external display. The one or more operational elements may also include one or more pushbuttons 110. The pushbuttons 110 are preferably mounted at an external face of the apparatus housing 102 so that they can be actuated/operated from the outside of the apparatus housing 102.

The operational elements may further include one or more indicators 108 that are preferably light indicators (e.g. LEDs) and can be preferably mounted to be visible from the outside of the apparatus housing 102. However, an indicator can also be implemented as a sound signal emitting device that is configured to produce one or more audible signals. The sound signal emitting device can be in the form of a loudspeaker that can emit audible signals and/or also speech signals as prerecorded or generated voice samples. Additionally or alternatively, the operational elements may also include a connection to a mouse (or other pointing device), to a USB (universal serial bus) device, or an Ethernet hub.

In general, the mentioned operational elements allow additional operation and interaction with the apparatus 100. Such operation may include any one of displaying instructions, displaying instructions on the display 106, displaying instructions for a next security article user to enter a security checkpoint and/or approach apparatus 100, issuing voice commands, issuing voice commands using the mentioned loudspeaker, presenting language options to a user for selection, receiving user input, receiving user input via a touchscreen display, receiving audio user input via a microphone, receiving as user input a selection of language, and/or prompting a security article user to present a security article or other required document. In some embodiments, the apparatus 100 is thus operable to receive as user input for example a request to eject the security article any time after it has been inserted, and/or to eject, including possibly reverse ejecting out of the printer inlet 160 which is described in greater detail below.

According to a further embodiment, the apparatus 100 is operable to measure its internal and/or external environment, such as by measuring the temperature and/or humidity of components accommodated within the apparatus housing 102 and/or spaces and/or openings thereof. In such embodiments, the apparatus 100 preferably includes one or more sensors selected from the group consisting of temperature sensors, humidity sensors, (air) pressure sensors, vibration sensors, accelerometers, localization devices and the like or any combination thereof. Said environment can also include parts or components of a security checkpoint employing the apparatus 100 for providing one or more desired functionalities. In this way, the apparatus is operable to surveil itself and/or any related elements including or forming also the security checkpoint. The surveillance can be effected by observing any relevant environment, location, or other alarm condition as described in conjunction with the present disclosure.

Location identification systems (localization devices) may be used for identifying the location of the apparatus. Such a system may be satellite based (GPS, GLONASS, GALILEO, etc.) and/or cellular network based (GSM, 3GPP, UMTS, GPRS, LTE, etc.). In general, the location identification system is operable to determine the location of the apparatus 100, and may be operable to periodically or continuously monitor the location of the apparatus 100. In some embodiments, the location identification system is operable to produce an alarm signal if the location of the apparatus 100 is not within a pre-defined location, for example. Further, said localization identification can be operable to disable the apparatus if the apparatus is removed from such a pre-defined location.

According to a further embodiment, the apparatus 100 is operable to trigger an alarm condition. Triggering an alarm condition may involve any one of communicating a message to a security station, generating an acoustic and/or optical signal, displaying instructions on a display, issuing voice commands, adjusting lighting conditions associated with a security checkpoint (e.g. 300 in FIG. 3) or an electronic gate (e.g. 300' in FIG. 4A), for example as part of automatic border control, closing an exit gate, locking the exit gate, closing the exit doorway, locking the exit doorway, locking the entrance doorway so as to impede an escaping, or (un)locking the entrance doorway, and/or opening the entrance doorway. The security checkpoint 300 (FIG. 3) or the electronic gate 300' (FIG. 4A) may also include a hand luggage scanner device (preferably employing X-rays).

The mentioned alarm conditions may be raised when a mislocation, displacement, and/or other modification or tampering is detected. This detection may involve one or more environment sensors such as those described herein. For example, an excessive heat can indicate a forced opening of the apparatus housing 102 or a security checkpoint housing and an accelerometer and/or positioning sensor can indicate a displacement. In general, the alarm conditions may also be raised in the case of malfunction, including any failure state of the components (reader support system, detectors, imaging system, processors, etc.) of the apparatus 100 and/or any components or elements related to the associated security checkpoint.

Further, the apparatus 100 shown in and described in conjunction with FIG. 1 comprises a biographic information capturing device 164 arranged to capture biographic information from the security article 200. As mentioned hereabove, the biographic information are typically personal details of the security article user, the security officer or the maintenance person, typically appearing as text in the visual inspection zone, and frequently also in the machine readable zone on the biographic information page of said security article. The biographic information capturing device may employ for this purpose the imaging device as described above in conjunction with the reader support system 150. In general, an image of the security article 200 is acquired so as to capture an image of the biographic information where that information is visible or optically detectable on the security article, such as in the form of printed text on the security article and/or a photograph or image of the authorized security article user, of the authorized security officer or of the authorized maintenance person. In addition, if the security article includes machine readable data that is visible, the biographic information capturing device may also capture the visible machine readable data, by employing corresponding processing, such as image processing, character recognition, barcode decoding, and the like. In general, the biographic information capturing device may therefore preferably comprise a camera, an optical scanner and/or an electronic data capturing device.

According to a further embodiment, the biographic information capturing device 164 may comprise, or may be formed by, an electronic data capturing device within the apparatus housing 102 (not directly visible in FIG. 1). Said electronic data capturing device can be adapted to read data from an electronic memory device within or attached to a security article. In such embodiments the electronic data capturing device thus comprises a wireless device to wirelessly capture the biographic information from an electronic storage device attached to the security article. For example, the electronic memory device may form part of a radio-frequency identification device (RFID) within a security article. For example, security articles in the form of passports may be provided with such an electronic memory device. Preferably, the electronic data capturing device includes a wireless communication device to permit wireless communication with an RFID device and to retrieve data from that device wirelessly. The electronic data capturing device may include one or more antennas (not shown) located in the apparatus housing 102 to facilitate wireless communication. For example, the read data includes biographic information regarding an authorized user of the security article (e.g. passport) and, optionally, biometric data regarding the authorized user. Generally, RFID can also be employed for storing security data which is not related to biometric data, or biographic information, such as e.g. security article issuing date and place.

Biometric data and/or biographic information can be, for example, stored, extracted and used, either to build a reference template (template data) or to be compared against a previously created reference template (comparison data).

Common security articles, e.g. articles supporting security in general and, in particular, serving to identify a security article user, may typically comprise a special space that is referred to as a machine readable zone MRZ (206). In an identity document as one possible example for a security article, such a MRZ can be for example a space provided in a lower portion of the identity information page, where the same or corresponding identity information as that is printed on the identity information page is encoded in an optical character recognition format. The MRZ can comprise the biographic information of the authorized user and typically consists of two lines having a length of 44 characters. In the MRZ there can be printed and encoded information including identity information, a name, a passport number, check digits, nationality, date of birth, gender, passport expiration date, and personal identity number. The MRZ may further comprises—often country dependent—supplementary information.

The MRZ and/or the biographic information and/or the biometric data may be printed with a security ink comprising one or more security materials selected from the group consisting of optically variable materials, luminescent materials, IR absorbing materials, light polarization materials, magnetic materials and combinations thereof, preferably luminescent materials, IR absorbing materials and combinations thereof such as those described herein.

As already mentioned, security articles, in particular articles serving to identify a security article user may further comprise, in addition to the MRZ, an electronic memory device in the form of a chip (integrated circuit) or an RFID device. Generally, such electronic memory devices are adapted to store and—optionally—also process data. Similar or identical information as that printed in the MRZ can be separately stored in the chip. Additionally, biographic information, biometric data and/or security data can be stored in the chip and/or in the RFID.

In the case that the biographic information capturing device comprises the above-mentioned electronic data capturing device (to capture electronic data stored in the security article), the electronic data capturing device typically includes wireless means (antennas and related components) to retrieve the data wirelessly from a storage via some sort of wireless link to be established with the electronic memory device on the security article to transfer data wirelessly. Alternatively, it is possible that the electronic data capturing device can capture the data via direct electric contact between contacts on the apparatus side and on the side of the security article.

The apparatus 100 described herein may also comprise a biometric data capturing device (e.g. 104) to capture, e.g. in real time, biometric data from the security article user of the security article 200, the security officer or the maintenance person. The captured biometric data may be compared with the biographic information (which may include reference biometric data) captured by the biographic information capturing device to authenticate the security article user, the security officer or the maintenance person as an authorized security article user, security officer or maintenance person of the security article. In this case, the biometric data consists of data that is captured directly from the security article user, the security officer or the maintenance person when the security article is presented for authentication. The mentioned comparing of biometric data and biographic information may involve any processing required for making possible a comparison and the determination of a sensible result.

Automated recordation of biometric data may be carried out with the help of one or more pieces of recording equipment. Typical recording equipment include without limitation cameras for capturing images, video cameras for capturing video information or audio-video information, IR (infrared) cameras operable to capture images in the IR region of the electromagnetic spectrum, and combinations thereof. Associated illumination means may be accordingly adapted with regard to the emission spectrum, intensity, and direction. Further typical recording equipment may be audio recorders, proximity detectors, thermal sensors, tactile sensors, vibration sensors, magnetic energy detectors, thermographic cameras and/or document scanners, microphones, ultrasound transducers, infrared radiation emitters (such as a near infrared radiation source) and detectors (such as a monochrome charge coupled device array camera (CCD)), pulse oximeters to measure oxygen content of blood, odor detectors.

For example, a biometric data capturing device may include an image capturing device (such as a camera) to capture one or more image(s) such as for example a face, part(s) of the body for visual or geometric recognition such as images of the fingers, hands and ear lobes (outer ear), images of the iris for iris recognition, images of the retina for retina recognition, images of veins, images of the movement (e.g. gait for gait analysis). Further, the biometric data capturing device, in particular the real time biometric capturing device, may include a microphone to capture a voice for voice analysis, a fingerprint reader, a palm-print reader, a pulse oximeter to capture blood oxygen levels, an odor detector, a monochrome charge coupled device (CCD) array to capture infrared images of veins when illuminated with near infrared light for vascular analysis, ultrasound transducers for capturing bone density, and any required equipment for acquiring the information on the desired type of biometric data.

An example of a biometric data capturing device is shown in FIG. 1 as biometric data capturing device 104. Specifically, the apparatus housing 102 may accommodate or feature an opening for biometric data capturing device 104 to capture biometric data, for example in the form of a scanner window. In other words, the apparatus housing 102 may include an aperture or opening as a biometric scanner window. In this example, the biometric data capturing device 104 is preferably dimensioned for receiving and supporting a finger. Specifically, the biometric data capturing device 104 of this embodiment can be operable to scan a finger of the security article user, the security officer or the maintenance person when presented at the window of device 104. However, any other suitable biometric data can be acquired through biometric data capturing device 104 (e.g. by means of a camera positioned behind the window of the biometric data capturing device 104).

Generally, however, the apparatus 100 may include a biometric data capturing device in any other suitable form as a biometric scanner or biometric reader (not directly shown in FIG. 1) that may employ some kind of housing aperture as, for example, in the form of the window shown and described for above biometric data capturing device 104.

The biometric data capturing device may be configured to produce a code or set of data in response to its scanning/capturing operation. The code produced may be used by the apparatus 100 in the manner of a passcode, for example, to permit or deny operation of any or all of its functions and/or permit or deny access to any feature of the apparatus 100, including permitting or denying access to open the apparatus 100 for maintenance or other servicing for example. In some embodiments, the biometric data capturing device of the apparatus 100 is operable to perform biometric scanning functions associated with a security checkpoint. Specifically, the biometric data capturing device may be operable to perform some or all of the scanning functions of a fingerprint scanner and/or palm-print scanner of a security checkpoint, or of an electronic gate (see also description in conjunction with FIGS. 3 and 4A), or, in general, automatic border control.

The apparatus 100 described herein also comprises a security feature detector 166 to detect a physical property of a security feature on and/or in the security article inserted into the reader support system 150. As shown, the present embodiment considers placing a security feature detector capable to detect a physical property of an exemplary security feature 204 on the security article 200 under the transparent reader support 152. The security feature detector may in general comprise one or more optical detectors, one or more magnetic detectors, one or more conductivity meters or a combination thereof such as described hereabove. The security feature detector to detect an optical property is preferably selected from the group consisting of detectors sensitive to optically variable characteristics, IR absorption characteristics, emission characteristics, light polarization characteristics and combinations thereof.

Specifically, embodiments of the present invention envisage that the genuineness of a security article is established (determined) by employing a security feature detector so as to detect a physical property of the security feature on and/or in said security article. The physical property described herein may be selected from the group consisting of optical properties, magnetic properties, conductivity properties and combinations thereof.

In some embodiments, the security feature detector comprises an optical detector that detects light emitted, reflected or transmitted by the security feature, or the absorbance (i.e. the missing fraction of light that was emitted toward the security feature), reflected or transmitted by the security feature if the optical property of the security feature is absorbance of light. This may be in response to stimulation applied by a stimulation (illumination) source which "stimulates" or illuminates the security feature. Such an optical detector can be in the form of a CCD, CMOS, VIS (visible light), IR (infrared) or 3D camera. The stimulus can also be effected by means of heating, cooling or applying a pressure to the security feature. In this case, any one from a light source, a heater, a chiller, and a pressure application device may be provided.

When the security feature detector is an optical detector or magnetic detector it may be positioned below the reader support 152 within the apparatus housing 102 and detect light reflected from the security article 200, e.g. from open pages of a passport booklet, transmitted through the reader support 152. The optical detector may detect the intensity, the wavelength(s) and/or the polarization of light incident on the detector. When the security feature detector is an electrical detector, contacts may be integrated into the receiving slot 156 or the reader support 152 to make electrical contact with the security feature. Alternatively, non-contact means could be used instead. It is also possible that the security feature detector is movable to detect the physical property of the security feature from different angles or positions (distances) relative to the security feature. This may be of particular advantage in the case of optically variable security features, e.g. security features printed with optically variable inks.

In general, a suitable security feature detector can comprise means for irradiating electromagnetic radiation toward the security feature for activating it, i.e. to "stimulate" the feature so as to be able to detect and evaluate a response from the security feature. In other words, a suitable security feature detector may comprise a source operable to produce electromagnetic radiation in a range of wavelengths of the electromagnetic spectrum and at least one imaging device operable to produce an image of the item.

The apparatus 100 described herein may also comprise a processor to process any captured information. Specifically, the processor may be configured to process the biographic information and the detected physical property to determine whether the security article is genuine and the security article user is an authorized user of the security article. In general, a processor is embodied by some kind of processing circuit comprising one or more integrated electron circuits and other active and passive components. Each such processing circuit typically includes one or more circuit units, such as a central processing unit (CPU), digital signal processor (DSP), embedded processor, etc., and any combination thereof operating independently or in parallel, including possibly operating redundantly. Each processing circuit may be implemented by one or more integrated circuits (IC), including being implemented by a monolithic integrated circuit (MIC), an Application Specific Integrated Circuit (ASIC), a Field Programmable Gate Array (FPGA), programmable logic controller (PLC), etc. or any combination thereof.

A processor usually incorporates or cooperates with one or more memory circuits that are able to store codes in the form of instructions for instructing a processor to implement the desired functionalities. Specifically, such memory circuits are typically operable to store digital representations of data or other information, including images, authentication codes, representations of security features and/or control information, measurement results, automated analysis results, and to store digital representations of program data or other information, including program code for directing operations of one or more of the processing circuits. One or more memory circuits may constitute a database (not shown), and/or be in electronic communication with a database. Additionally or alternatively, one or more databases may be implemented separately from the processor and/or apparatus. Each database typically functions to store information, typically in the form of recordable and retrievable data for use by the processor, including data records stored in association with other data records.

Typically, the memory circuits are each all or part of a digital electronic integrated circuit or formed from a plurality of digital electronic integrated circuits. The memory circuits may be implemented as Read-Only Memory (ROM), Programmable Read-Only Memory (PROM), Erasable Programmable Read-Only Memory (EPROM), Electrically Erasable Programmable Read-Only Memory (EEPROM), flash memory, one or more flash drives, universal serial bus (USB) connected memory units, magnetic storage, optical storage, magneto-optical storage, etc. or any combination thereof, for example. The memory circuits may be operable to store digital representations as volatile memory, non-volatile memory, dynamic memory, etc. or any combination thereof.

The processor in conjunction with its corresponding memory is typically operable to run any one or more operating systems, including real-time operating systems such as WinCE, Symbian, OSE, Embedded LINUX, non-real time operating systems such as Windows, Unix, Linux, and any combination thereof. The processor in conjunction with its corresponding memory may be operable to implement multi-tasking methods involving multiple threads of executable code, for example.

Further, a communications controller may be provided for facilitating the transmission, reception, and exchange of data and/or information between the processor and other computing systems via a network, which may be the Internet for example. Connection to the network may be implemented by any wired or wireless connection, including a copper wire link, a coaxial cable link, a fiber-optic transmission link, a radio link, a cellular telephone link, a satellite link, a line-of-sight free optical link, and any combination thereof, for example.

The apparatus 100 described herein also includes an output device for outputting a signal indicative of the determination whether the security article is genuine and the security article user is an authorized user of the security article. Specifically, the captured biographic information and the detected physical property of the security feature are processed to determine whether the security article is genuine and the security article user is an authorized user of the security article or the identity of the security article user. The output device generally outputs a signal indicative of such a determination. The output device can be, for example, a sound generator, a speaker, a light generator for emitting a luminous signal, a display, a computer screen, or a gate which is opened in the case of a positive determination.

Alternatively, the output device may be a printer system, which is capable of printing the results of the determination, such as e.g. a stamp, in particular an exit or admission stamp, a certificate of authenticity, a visa, a text, a code, an image, a pattern, a logo, indicia, and/or combination thereof. The optional printer system is described in greater detail below. In this way, said results can be printed for example directly on the security article, such as a passport. In general, such a printer system is preferably selected from the group consisting of an inkjet printer, a thermal printer, a laser printer and a laser marking printer. Said result may be printed with a security ink comprising one or more security materials selected from the group consisting of optically variable materials, luminescent materials, IR absorbing materials, light polarization materials, magnetic materials and combinations thereof, preferably luminescent materials, IR absorbing materials and combinations thereof such as those described herein. Further, a result of determination can be preferably any one of the group of printing/affixing a stamp and/or a visa to/on the security article, opening a gate, activating a green light, playing a special sound, playing back a prerecorded or ad hoc generated voice message such as "you may now proceed" or "you can advance", and the like.

When the apparatus 100 includes the optional printer system, the apparatus 100 has an inlet, such as the printer inlet 160 shown in FIG. 1, for receiving the security article 200, here shown as an exemplary passport booklet. In this case, the apparatus 100 also includes an access door, such as a printer inlet flap 162, through which the security article 200 can pass when being received by the printer inlet 160. The printer inlet flap 162 may include a transparent window for viewing into the apparatus housing 102. The printer inlet flap 162 may not open for access unless appropriate identification credentials are obtained, such as by one or more of: (a) the operation of the biometric data capturing device (e.g. 104); (b) the entry of a suitable passcode; and (c) the authentication of the security article, including a document that may be the same as or different from the security article, in particular the passport booklet, by operation of the reader system, for example. Specifically, the security article that is examined through the reader support 152 may not necessarily be the same as the document that is subject to printing. Further, also the same security article may be examined and printed, but, however, on different areas or pages of the security article 200. Specifically, a first page of a passport booklet as a security article may be subject to examination via reader support 152, and another page of the security article, in particular the passport booklet may be subject to printing.

The process of printing may involve determining a printing area of the security article. Generally, the determined printing area is then subject to printing for printing the desired element such as those described herein. The printing area may be identified as the parts of security article which are found to be suitable for printing and/or desirable to be printed on. It thus may be a part of the security article with suitable properties and/or coloring so that a printing can reliably be carried out. The printing area may thus be an empty page, an empty part of a page, a page carrying a stamp, a label, or a mark, or it can be a special feature of the security article. Determining a printing area may involve determining a printing area of the security article, which, in turn, may involve receiving the corresponding through a printer inlet such as the one described in FIG. 1. Receiving a security article through a printer inlet may involve sensing the presence of a security article proximate a stopper gate of the printer system. Sensing the presence of a security article proximate a stopper gate of the printer system may involve receiving an output from a printer sensor of the printer system.

Determining a printing area may involve displaying an image of the security article. Displaying an image of the security article may involve capturing an image of the security article. Capturing an image of the security article may involve capturing the image by an imaging device of the printer system. Determining a printing area of the security article may involve determining whether the security article is suitable for printing. Determining whether the security article is suitable for printing may involve determining whether the image matches with the authenticated security article. Determining whether the security article is suitable for printing may involve performing image analysis of the image. Determining whether the security article is suitable for printing may involve receiving user input.

Determining a printing area of the security article may involve receiving as a security officer's input a printing area. Determining a printing area of the security article may involve performing image analysis of the image. The method may involve printing on the authenticated security article within the printing area.

Receiving a security article and/or a document (said document being different from the security article and being for example a certificate of authenticity or any other issued document) through a printer inlet may involve clamping the security article and/or document at its leading edge, so as to, for example, hold the security article and/or document to be printed on in a desired position. Clamping the security article and/or document at its leading edge may involve moving a platen vertically. Said platen can be typically a flat metal plate pressed against the security article and/or document. Moving a platen vertically may involve moving the platen upwardly toward an upper frame plate of a transport frame of the printer system. Clamping the security article and/or document at its leading edge may involve moving a lower clamping plate of a clamping frame vertically. Moving a lower clamping plate of a clamping frame vertically may involve moving the lower clamping plate upwardly toward the upper frame plate.

The frame may include an upper frame member and a lower frame member. The printing support may extend longitudinally into the space defined between the upper frame member and the lower frame member. The upper frame member may be dimensioned to limit the upward vertical movement of the printing support. The printer system may be operable to clamp the security article and/or document between the printing support and the upper frame member. The printer system may be operable to clamp the security article and/or document between the lower frame member and the upper frame member. The printer system may be operable to release clamping of the security article and/or document.

Receiving a security article and/or document through a printer inlet may involve moving a support plate of the printer system vertically. Moving a support plate of the printer system vertically may involve moving the support plate so as to clamp the security article and/or document at a non-edge area of the security article and/or document. Clamping the security article and/or document at a non-edge area may involve clamping the security article and/or document between the support plate and a feeding roller. Receiving a security article and/or document through a printer inlet may involve clamping the security article and/or document at a non-edge area between the platen and the feeding roller. Receiving a security article and/or document through a printer inlet may involve moving the security article and/or document longitudinally to an imaging position of the printer system. Moving the security article and/or document longitudinally to an imaging position of the printer system may involve moving the platen and the transport frame. Moving the platen and the transport frame may involve moving the platen and the transport frame together longitudinally. Moving the security article and/or document longitudinally to an imaging position of the printer system may involve moving the clamping frame. Moving the clamping frame may involve moving the clamping frame longitudinally along a rail. Moving the clamping frame may involve moving the clamping frame longitudinally along a rack.

Transporting the authenticated security article may involve pulling the authenticated security article at its leading edge. Transporting the authenticated security article may involve moving a platen and a transport frame of the printer system. Moving a platen and a transport frame of the printer system may involve moving the platen and the transport frame longitudinally toward a printer outlet (for example via printer inlet flap 162 as shown in FIG. 1 when the article is inserted in and ejected from the same opening). Moving a platen and a transport frame of the printer system may involve moving the platen and the transport frame along a toothed rail. Transporting the authenticated security article may involve moving a clamping frame of the printer system.

Moving a clamping frame of the printer system may involve moving the clamping frame longitudinally toward the printer outlet. Moving a clamping frame of the printer system may involve moving the clamping frame along a rack by driving a pinion gear engaged with the rack.

The apparatus housing 102 may further accommodate a printer inlet guide for guiding the security article and/or document through the printer inlet 160. The printer inlet guide may include one or more printer inlet guide walls. The printer inlet guide may include two printer inlet guide walls. The printer inlet guide may include four printer inlet guide walls. The printer inlet guide may project from the inlet aperture inwardly. The printer inlet guide may project within the apparatus housing 102. The printer inlet guide may project toward a printer platen. The printer inlet guide may project toward a printing support.

The printer system may include a transport system for transporting the security article and/or document through the printer system. The transport system may include the printing support. The printing support may include the platen. The printing support may be a printing support plate. The printing support may be plate shaped. The printing support may be dimensioned for supporting the security article and/or document. The printing support may be operable to support the security article and/or document. The reader system may include one or more support posts for supporting the printing support. The printing support may be attached to the support posts. The support posts may be telescopic. The printing system may be operable to move the printing support in a vertical direction by causing the support posts to move telescopically. The printing system may be operable to move the printing support in an upward vertical direction by causing the support posts to lengthen. The printing system may be operable to move the printing support in a downward vertical direction by causing the support posts to shorten.

The printing support may include a plurality of longitudinally adjacent printing support plates. One of the plurality of longitudinally adjacent printing support plates may be moveable in a vertical direction independently of another one of the plurality of longitudinally adjacent printing support plates. One of the plurality of longitudinally adjacent printing support plates may have a first vertical height and another one of the plurality of longitudinally adjacent printing support plates may have a second vertical height. The one of the plurality of longitudinally adjacent printing support plates may abut the other one of the plurality of longitudinally adjacent printing support plates when the one plate and the other plate are at the same vertical height.

The one of the plurality of longitudinally adjacent printing support plates may be spaced apart from the other one of the plurality of longitudinally adjacent printing support plates so as to form a longitudinal gap there between. The printing support may include a plurality of transversely adjacent printing support plates. One of the plurality of transversely adjacent printing support plates may be moveable in a vertical direction independently of another one of the plurality of transversely adjacent printing support plates. One of the plurality of transversely adjacent printing support plates may have a first vertical height and another one of the plurality of transversely adjacent printing support plates may have a second vertical height. The one of the plurality of transversely adjacent printing support plates may abut the other one of the plurality of transversely adjacent printing support plates when the one plate and the other plate are at the same vertical height. The one of the plurality of transversely adjacent printing support plates may be spaced apart from the other one of the plurality of transversely adjacent printing support plates so as to form a transverse gap therebetween. The printing support may include a first pair of longitudinally adjacent printing support plates and a second pair of longitudinally adjacent printing support plates, the first pair being transversely adjacent to the second pair.

The transport system may include an entrance feeder. The entrance feeder may be mounted within the apparatus housing. The entrance feeder may be mounted above the printing support. The entrance feeder may be dimensioned to limit the upward vertical movement of the printing support. The entrance feeder may include a roller. The roller may be free-spinning. The roller may be motorized. The motorized roller may be a bi-directionally motorized roller. The entrance feeder may include a plurality of rollers of different cross-sectional diameters. The plurality of rollers may be mounted such that the lowest points of their outer surfaces, respectively, are at a same vertical height. The plurality of rollers may be mounted such that a larger diameter roller is closer to the printer inlet than a smaller diameter roller.

The printer system may include a printhead for printing on the security article and/or document. The printer system may be operable to cause the printhead to move transversely. The roller may be mounted closer to the printer inlet than the printhead. The printing support may extend longitudinally closer to the printer inlet than the roller. The printing support may extend longitudinally so as to avoid extending as far from the printer inlet as the printhead. The printing support may extend longitudinally so as to avoid extending beneath the printhead. The printing support may extend longitudinally as far from the printer inlet as the printhead. The printing support may extend longitudinally to a point beneath the printhead.

The platen may be dimensioned to support the security article and/or document in proximity to the printhead. The platen may be dimensioned to support the security article and/or document beneath the printhead. The platen may be dimensioned to support the security article and/or document at a printing zone defined beneath the printhead. The printer system may include a frame for clamping the security article and/or document at its leading edge (i.e. the edge of the security article closest to the printer outlet when the security article is located within the apparatus housing).

The printer system may be operable to cause the frame to move longitudinally. The printer system may be operable to cause the frame to move longitudinally along a toothed rail. The printer system may be operable to cause the frame to move longitudinally along a rack by operation of a pinion gear. The printer system may be operable to cause the frame to transport the security article by pulling the security article at its leading edge. The printer system may be operable to transport the security article and/or document from a receiving position of the printer system to an imaging position of the printer system.

The printer system may be operable to transport the security article and/or document from the receiving position to a printing position of the printer system. The printer system may be operable to transport the security article and/or document from the imaging position to the printing position. The printing position may be defined as the position of the frame when the security article and/or document is beneath the printhead, including possibly when a printable area of the security article and/or document is beneath the printhead. The printer system may be operable to transport the security article and/or document from the printing position to a printed position of the printer system. The printer system may be operable to transport the security article and/or document from the printed position to an exit position of the printer system.

The exit position may be defined as the position of the printer system when the security article and/or document is retrievable from outside of the apparatus housing. The exit position may be defined as the position of the printer system when the security article and/or document is retrievable from outside of the apparatus housing. The exit position may be defined as the position of the printer system when the security article and/or document is retrievable by an automated module from outside of the apparatus housing. The exit position may be defined as the position of the printer system when the security article and/or document is placed beyond the printer outlet.

The printer system may include a stopper. The printer system may be operable to activate the stopper so as to inhibit longitudinal movement of the security article and/or document beyond a definable point. The printer system may be operable to deactivate the stopper so as to not inhibit longitudinal movement of the security article and/or document. The stopper may be a gate. The printer system may be operable to close the gate so as to inhibit longitudinal movement of the security article and/or document beyond a definable point. The printer system may be operable to open the gate so as to not inhibit longitudinal movement of the security article and/or document. The stopper may be rotatably coupled to the frame. The stopper may be hingedly connected to the frame. The stopper may be slidably coupled to the frame.

The printer system may include a printer system imaging device for capturing images. The printer system imaging device may be mounted within the apparatus housing. The printer system imaging device may be operable to capture images of the security article and/or document when the security article and/or document is being supported by the printing support. The printer system imaging device may be operable to capture images of the security article and/or document when the security article and/or document is being clamped by the frame. The printer system imaging device may be operable to capture images of a printable area of the security article and/or document when the security article and/or document is being clamped by the frame.

The printer system may include a transport conveyor for conveying the security article and/or document. The printer system may include a transport conveyor for conveying the security article and/or document when the printer system is in its printing position. The transport conveyor may include a transport conveyor belt having a push-plate projecting therefrom. The push-plate may be dimensioned to engage the security article and/or document. The push-plate may be dimensioned to engage the security article and/or document at one edge thereof. The transport conveyor may be operable to push the security article and/or document when the push-plate is contacting the security article and/or document. The transport conveyor may be operable to push the security article and/or document by the push-plate when the transport conveyor is conveying the security article and/or document. The transport conveyor may be mounted within the apparatus housing for pushing the security article and/or document in a longitudinal direction.

The transport conveyor may be mounted within the apparatus housing for pushing the security article and/or document in a forward direction by making contact between the push-plate and a substantially central portion of the trailing edge of the security article and/or document. The transport conveyor may be mounted within the apparatus housing for pushing the security article and/or document in a reverse direction by making contact between the push-plate and a substantially central portion of the leading edge of the security article and/or document.

The printer system may include a plurality of transport conveyors. The printer system may include first and second parallel, spaced-apart transport conveyors, each of the transport conveyors having a push-plate. The parallel, spaced-apart transport conveyors may be mounted within the apparatus housing such that the push-plates contact the security article and/or document at opposing ends of one edge of the security article and/or document. The transport conveyor may be operable to, when the gate is open, convey the leading edge of the security article and/or document item closer to the printer outlet than the frame. The transport conveyor may be operable to, when the gate is open, convey the security article and/or document by pushing the trailing edge of the security article and/or document by the push-plate so that the leading edge of the security article and/or document becomes closer to the printer outlet than the frame.

The printer system may include an edge bracket. The edge bracket may be mounted within the apparatus housing. The edge bracket may extend vertically adjacent a longitudinal edge of the printing support. The edge bracket may be dimensioned to limit the transverse movement of the security article and/or document when the security article and/or document is being transported by the transport system. The edge bracket may include a cantilevered section. The edge bracket may be dimensioned to limit the vertical movement of the edge of the security article when the security article and/or document is being transported by the transport system. The cantilevered section may include a horizontally disposed subsection and an inclined section. The inclined section may be inclined upwardly toward the printer inlet. The printer system may include a pair of edge brackets disposed at opposing sides of the printing support.

The printer system may include an exit system. The transport system may include the exit system. The exit system may include a ramp defining an exit path toward the printer outlet. The exit path may be inclined. The exit path may be vertically inclined. The exit path may extend horizontally. The exit path may be upwardly inclined. The exit path may be downwardly inclined. The ramp may be rotatably coupled to the remainder of the apparatus housing. The printer system may include a hinge for hingedly connecting the ramp to the remainder of the apparatus housing.

The ramp may be telescopic. The ramp may have an adjustable length. The ramp may include a ramp cut-out. The ramp may be cut-out at one corner thereof. The ramp may be cut-out along one side edge thereof. The exit system may include an exit conveyor for conveying the security article and/or document along the exit path. The exit conveyor may include an exit conveyor belt. The exit conveyor belt may have an exit push-plate projecting from the conveyor belt. The exit push-plate may be dimensioned for engaging the security article and/or document. The exit push-plate may be dimensioned for engaging with one edge of the security article and/or document. The exit conveyor may be operable to convey the security article and/or document by pushing the security article when the exit push-plate is contacting the security article.

The exit system may include an exit clamp. The exit clamp may be operable to clamp the security article and/or document. The exit clamp may be operable to clamp the security article and/or document along one side edge thereof. The exit system may be operable to move the exit clamp along the exit path. The exit system may include the outlet flap. The exit system may include an upper exit guide. The exit system may include an overhang. The exit system may include exit sidewalls. The exit system may include exit rollers. The exit rollers may be dimensioned to contact the security article and/or document along side edges of the security article or document, as the case may be.

The printer system may include a hardening system and/or a curing system operable to harden, stabilize, fix, and/or cure the print onto the security article. The hardening and/or curing system may comprise one or more components selected from the group consisting of heating systems, fans, light sources (UV, visible, and/or IR) and combinations thereof.

The printer system may employ memory circuits that are typically operable to store digital representations of data or other information, including images, authentication codes, representations of security features and/or control information, and to store digital representations of program data or other information, including program code for directing operations of one or more of the processing circuits.

As already mentioned, the apparatus 100 described herein may also comprise a display, for example, as the display 106 already mentioned and shown in FIG. 1. The display may be of any suitable and already listed type (LCD, LED-D, OLED-D, VFD, etc.) and may also provide touch-screen functionality. In this way, above all in conjunction with a touch-screen functionality, an internal display may be a reliable and vandalism-safe solution for providing an interactive display that allows interactions with the security article user, the security officer or the maintenance person, i.e. displaying instructions or any other desired information to the security article user, the security officer or the maintenance person and/or receiving input. For example, an internal display may be arranged to be flush mounted with a corresponding part of the apparatus housing so as to minimize the number of weak points, which, in turn, may improve protection against vandalism.

Alternatively or additionally, the apparatus 100 may be operable to connect to an external display. The respective connector may be provided in any suitable form and carrying any suitable signal or protocol (including e.g. RGB, VGA, HDMI, USB, and the like). By using an external display, additional information can be displayed to a security article user, a security officer or a maintenance person. Specifically, the screen size can be enlarged without increasing the size of the apparatus 100 or its apparatus housing 102 so as to provide more information or magnified information. Further the external display can be mounted in a manner to improve legibility or to conceal the displayed content from any individual in the vicinity but not being or belonging to the actual individual, i.e. the security article user, a security officer or a maintenance person, of the apparatus 100.

The apparatus 100 described herein may also include an imaging device (image capturing device, not directly shown FIG. 1), such as a camera disposed within the apparatus housing 102 and directed toward the security article 200. The image capturing can be preferably carried out as part of a quality control function and the exemplary camera may be configured to acquire an image and/or to be directed at the document after printing has occurred. In such embodiments, the apparatus 100 may be operable by a security officer or a maintenance person to perform any or all of the following quality assurance functions: (a) capturing/acquiring quality assurance images, including possibly a streaming video of images, of the printing that has occurred; (b) displaying the quality assurance images on the display 106 or other connected (external or remote) display; (c) receiving an indication of acceptance or rejection of the quality of the printing that has occurred; (d) performing automated image analysis for determining an indication of quality associated with the quality assurance images; (e) transmitting the indication of quality received or determined by the apparatus 100 to a remote device (e.g. central server, remote display); (f) transmitting the quality assurance images to a remote device (e.g. central server); and/or (g) receiving from the remote device an indication of the quality of the printing that has occurred.

In a further embodiment, the reader support 152 is transparent, thereby permitting the imaging device of the system produce images of the security article 200, in particular the passport being when supported by reader support 152. Preferably one or more sources (not shown in FIG. 1) of electromagnetic radiation (light) housed within the apparatus housing 102 are emitting electromagnetic radiation of selectable wavelengths toward the reader support 152. In this embodiment, the system's imaging device and the sources have line-of-sight positioning within the apparatus housing 102 relative to the reader support 152, such as by having internal walls (not shown in FIG. 1) projecting inwardly from around the perimeter of the reader support 152, the sources being attached to such internal walls and directed toward the reader support 152, the system's imaging device being mounted within the apparatus housing 102 at an adjacent end of such walls and generally facing the reader support 152.

In some embodiments, the imaging device is mounted adjacent the bottom inner surface of the apparatus housing 102. In some embodiments, the apparatus includes mirrors for redirecting the path of electromagnetic radiation produced by the sources, reflected from the security article positioned at the reader support 152, and received by the imaging device. In such embodiments, mirrors may advantageously permit greater flexibility of location and position within the apparatus housing 102 of the sources and/or the imaging device. In general, however, the imaging device may be mounted anywhere and directed in any direction provided the imaging device is operable to capture images of the security article when it is being supported by the reader support 152.

The apparatus 100 described herein may also include a communication device (not directly shown FIG. 1). Such a communication device is operable to effect communications with electronic devices which are external to the apparatus 100, such as a central data storage memory (database). In some embodiments, the apparatus 100 is operable to effect communications via a Local Area Network (LAN), the wireless pendant WLAN (also WiMAX, WiFi, and the like), a Wide Area Network (WAN), private communications network, a Virtual Private Network (VPN), a secure (i.e. encrypted) communications network, the Internet, or any combination thereof.

For example, the communication device may be operable to provide communications between the apparatus 100 and a remote device such as a central server (not shown), including a central server having a database which is accessible to the apparatus 100. Communications between the apparatus 100 and the remote device may include communications for the purpose of user control, including shared user control, reporting of logged records, other purposes, and any combination thereof for example.

The communication device of the apparatus 100 of the corresponding embodiment may include generally any number of devices (not shown) for effecting such communications. By way of example, the communication device may include a computer, a modem, a portable communications device, a facsimile machine, a phone (including a land-line-connected or a wireless phone such as a cellular or satellite phone), a radio (including a two-way radio), a personal digital assistant or any other equipment unit suitable for electronic communications. In respective embodiments, the communication device may be operable to effect electronic communications via any wired or wireless connection, including a copper wire link, a coaxial cable link, a fiber-optic transmission link, a radio link, a cellular phone link, a satellite link, a line-of-sight free optical link, or any combination thereof, for example. The communication device may be controlled by the processor in conjunction with its corresponding memory. Additionally or alternatively, the communication device may have its own processing circuits (not shown) and/or its own memory circuits (not shown).

The communication device may also include in some embodiment a location identification system (localization device) such as those described herein. In embodiments wherein the location identification system is operable to produce an alarm signal if the location of the apparatus 100 is not within a pre-defined location, for example, the apparatus 100 is operable to communicate the alarm signal and/or the current location of the apparatus 100, such as by transmitting an indication of the alarm signal and/or the current location to the remote device (e.g. central server) using the communication device. Further, the apparatus 100—or part(s) of it—may be configured to be automatically disabled if it is not correctly positioned and/or the apparatus 100 is removed from a pre-defined location.

The above-mentioned identification or determination of the location of the apparatus 100 may be part of the more general concept of the security of the apparatus. The mentioned location identification device may include respective antennas (satellite, cellular network, wireless network and the like). Specifically, the apparatus and/or communication device may employ an antenna for wireless communication and being operable to wirelessly communicate at least one of its location and an indication whether the location is within a pre-defined permitted zone. The apparatus and/or communication device may also be operable to communicate any other failure or alarm state of the apparatus as discussed in greater detail above.

The apparatus 100 or the communication device may also include in some embodiment a power management system. Such a power management system may be configured to accept specified electrical power, which may be alternating or direct current electricity at a specified voltage, including any specified voltage in the range of 5V to 400V for example. The apparatus 100 may include one or more batteries for powering the apparatus 100, including possibly rechargeable batteries. Additionally or alternatively, the apparatus 100 may include an Uninterruptible Power Supply (UPS) for backup powering of the apparatus 100. In some embodiments, the power management system of the apparatus 100 is operable to manage electrical power associated with the security checkpoint 300.

Figure 3:
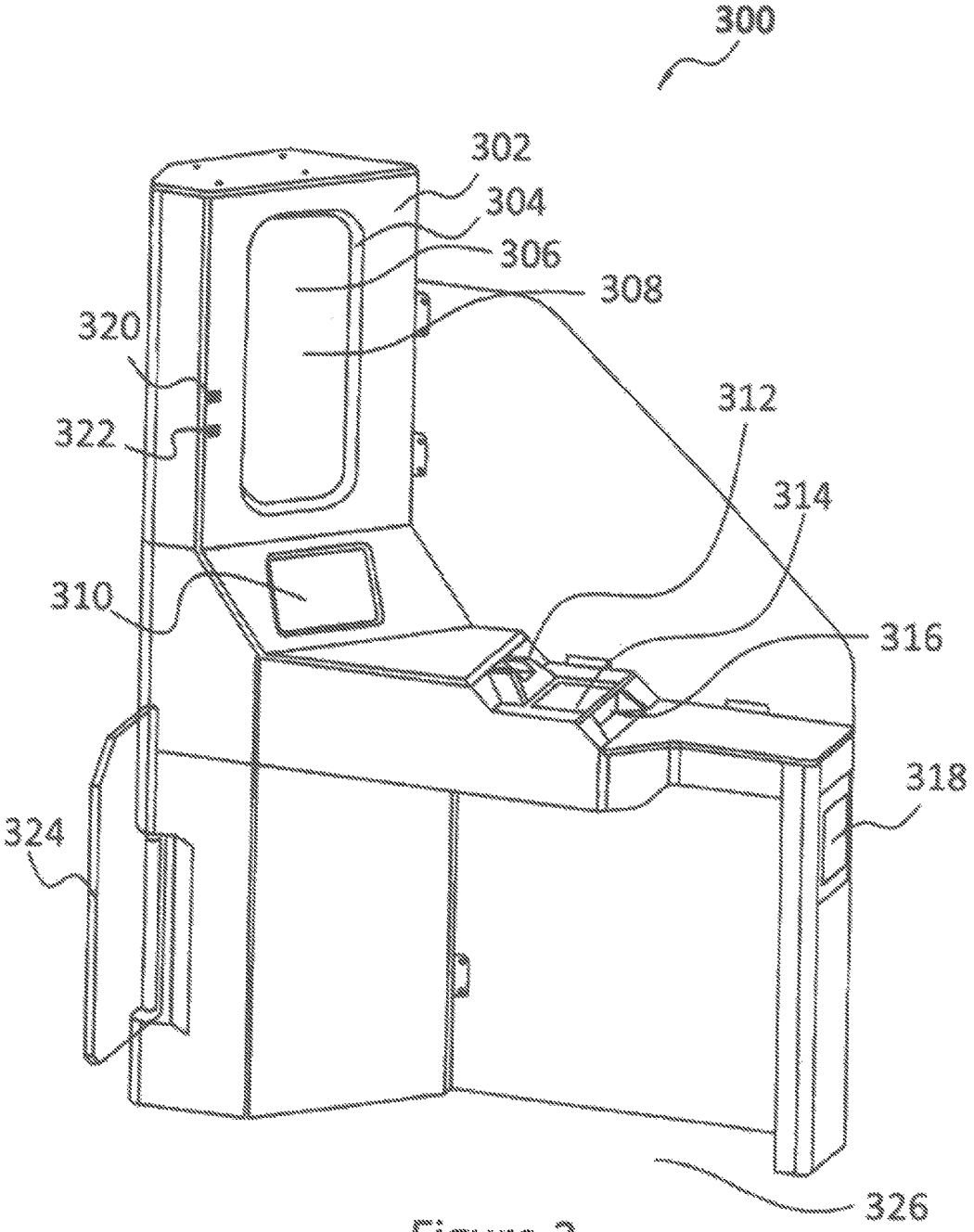
FIG. 3 shows a schematic view of a security checkpoint according to an embodiment of the present invention.

FIG. 3 shows a schematic view of a security checkpoint 300 according to an embodiment of the present invention. The security checkpoint 300 includes a security checkpoint housing 302 that includes a mirror frame 304 for supporting a one-way mirror 306. As shown, the security checkpoint 300 includes an entrance 326, possibly provided with an entry gate (as such not shown in FIG. 3), an exit gate 324, and a security console 440. The security console 440 may be integrated with the security checkpoint 300 as shown in the Figure, or may be provided as a stand-alone apparatus. For example, in the security checkpoint 300 the apparatus 100 shown and described in conjunction with FIG. 1 can be incorporated to perform the scanning and detection functions of the security article and the printing on the security article, if for example the optional printer part of the apparatus 100 is present. The apparatus 100 could also provide the control and processing functions for the security checkpoint 300. As generally shown in FIG. 3, the security checkpoint 300 can be a combination of a security console 440 with at least an exit gate 324.

The security checkpoint 300 (FIG. 3) or the electronic gate 300' (FIG. 4A) may comprise one or more displays that are visible when approaching the entrance of or the security checkpoint as such. For example, an entrance display 318 is provided near the entrance to the main area of the security checkpoint 300. Typically, the entrance display 318 is of an LCD or related type (LEDD, OLEDD, VFD, etc.). The entrance display 318 may be employed to provide instructions for a security article user to enter the main area of the security checkpoint and to instruct others not to approach the security checkpoint 300 when someone else is already present in the security checkpoint 300, for example.

The security checkpoint 300 may be provided with a one-way mirror 306 for concealingly permitting the automated recordation of data, in particular biometric data, concerning a security article user at the security checkpoint. One-way mirror 306 is typically a half-silvered mirror. In general, the one-way mirror 306 can be any object or device that functions to reflect light at the outer side 308 of the one-way mirror external to the security checkpoint housing 302; and to pass light through the one-way mirror 306 in the direction from its outer side 308 to its inner side inside of the security checkpoint housing 302. A security article user (not shown) at the security checkpoint 300 standing in front of the one-way mirror 306 would see his/her own reflection instead of seeing the equipment hidden behind the one-way mirror 306. The use of a one-way mirror 306 advantageously encourages security article users at the security checkpoint 300 to reveal their faces to the hidden equipment to the extent that a mirror μsychologically attracts the gaze of a security article user. The use of a one-way mirror 306 may also advantageously permit the automated detection of evasiveness to the extent that it is considered unnatural for a security article user to avoid eye-contact with a reflective mirror, thus attempts to avoid looking at the one-way mirror 306 can be detected by the hidden equipment and recorded for security purposes as an indicator of evasiveness. Thus, the one-way mirror 306 permits various equipment disposed within the security checkpoint housing 302 behind the one-way mirror 306 to record data about objects and persons (not shown) external to the security checkpoint housing 302 at the security checkpoint 300 without allowing the equipment to be seen from outside the security checkpoint housing 302.

The mentioned equipment may include one or more magnetic energy detectors operable to detect magnetic energy emanating from outside of the security checkpoint housing 302. The detectors of the hidden equipment may be installed at various positions and locations behind the one-way mirror 306 to suit particular uses of the security checkpoint 300. Additionally or alternatively, one or more detectors may be installed at other concealed and/or unconcealed locations of the security checkpoint 300 for detecting electromagnetic radiation at a variety of positions and locations within and/or around the security checkpoint 300.

In some embodiments, the hidden equipment includes one or more sensors. Typically, a sensor is disposed at the inner side of the one-way mirror 306 for sensing measurable physical phenomena other than electromagnetic radiation. The sensors may be or may include transducers, and may produce an electronic signal which may be a digital or analogic signal. For example, the sensors may include one or more vibration sensors for sensing vibrations of the one-way mirror 306. In some embodiments, the sensors include one or more tactile sensors disposed at the outer side 308 of the one-way mirror 306 for sensing force or pressure applied to the one-way mirror 306 at its outer side 308. In some embodiments, the sensors include one or more thermal sensors for sensing heat, including possibly measuring temperature.

The sensors of the hidden equipment may be installed at various positions and locations behind the one-way mirror 306 to suit particular uses of the security checkpoint 300. Additionally or alternatively, one or more sensors may be installed at other concealed and/or unconcealed locations of the security checkpoint 300 for sensing measurable physical phenomena at a variety of positions and locations within and/or around the security checkpoint 300.

The hidden equipment may include at least one source of lighting or other electromagnetic radiation. For example, one or more IR (infrared) sources of electromagnetic radiation in the IR region of the electromagnetic spectrum may emit IR (infrared) radiation from its concealed location behind the one-way mirror 306 outwardly from the security checkpoint housing 302. Emitting IR radiation by an IR source advantageously permits one or more cameras and/or one or more detectors, including possibly one or more IR cameras and/or one or more IR detectors, to image and/or detect, respectively, external objects or persons at the security checkpoint 300 under exposure to IR radiation. As a further example, one or more sources may produce visible light, such as for backlighting of the one-way mirror 306.

In some embodiments, one or more UV (ultraviolet) sources are operable to produce electromagnetic radiation in the UV region of the electromagnetic spectrum, which advantageously permits one or more cameras and/or one or more detectors to image and/or detect, respectively, external objects or persons at the security checkpoint 300 under exposure to UV (ultraviolet) radiation. By way of example, in some embodiments one or more UV cameras and/or one or more UV detectors image and/or detect, respectively, electromagnetic radiation in the UV region of the electromagnetic spectrum while the UV sources are emitting UV radiation. By way of further example, in some embodiments one or more visible light cameras and/or visible light detectors image and/or detect, respectively, electromagnetic radiation in the visible light region of the electromagnetic spectrum while the UV sources are emitting UV radiation, so as to capture visible light fluorescent reflections from external objects and persons at the security checkpoint 300.

In some embodiments, one or more sources are implemented as light-emitting diodes (LEDs). Additionally or alternatively, various sources may be implemented as lasers, incandescent lighting, halogen lighting, neon lighting, fluorescent lighting, other implementations of lighting, or any combination thereof for example. One or more of these sources may also be arranged behind the half-way mirror, so that they are invisible or only barely noticeable at least in an off-state. Furthermore, sources of non-visible light (i.e. generally not noticeable by the unaided or naked human eye) can in this way effectively concealed. The sources of the hidden equipment may be installed at various positions and locations behind the one-way mirror 306 to suit particular uses of the security checkpoint 300. Additionally or alternatively, one or more sources may be installed at other concealed and/or unconcealed locations of the security checkpoint 300 for providing illumination at a variety of positions and locations within and/or around the security checkpoint 300. In general, the sources can be arranged the mirror 306, in the mirror frame, and/or at any other suitable location of the checkpoint 300.

In some embodiments, the hidden equipment includes one or more detectors of electromagnetic radiation. Typically, a detector produces an indication of detected radiation which is not an image, and thus the detector is not a camera. Indications produced by the detector may include an electronic signal which may be a digital or analog signal, for example. Various detectors may be operable to detect electromagnetic radiation in wide or narrow ranges of wavelengths of the electromagnetic radiation. For example, the detectors may include one or more IR (infrared) detectors operable to detect electromagnetic radiation in the IR region of the electromagnetic spectrum. The detectors may include one or more visible light detectors operable to detect electromagnetic radiation in the visible light region of the electromagnetic spectrum. The detectors may include one or more UV (ultraviolet) detectors operable to detect electromagnetic radiation in the UV region of the electromagnetic spectrum. The detectors may include one or more proximity detectors operable to detect the presence, including possibly the distance, between the one-way mirror 16 and external objects or persons at the security checkpoint 10. The detectors may include one or more motion detectors operable to detect the motion of external objects or persons at the security checkpoint 300.

The security checkpoint 300 may further include a frame equipment installed within the security checkpoint housing 302 adjacent or proximate to a mirror frame 304. In variations, the mirror frame 304 equipment includes one or more pieces of equipment similar or analogous to the pieces of equipment such as the camera(s), detector(s), sensor(s) and source(s) in any number and combination thereof to suit particular uses of the security checkpoint 300.

In some embodiments, one or more portions of the mirror frame 304 may be transparent, translucent or one-way mirror type material, for example to suit various security purposes. By way of example, one or more portions of the mirror frame 304 may be made of a transparent material permitting at minimal energy loss the outward transmission of electromagnetic radiation, such as visible light, from one or more sources disposed proximate to the mirror frame 304. For example, different colored LED lighting may be employed to indicate status conditions, such as solid red lighting around the perimeter of the one-way mirror 306 when a security article user is not authorized or permitted to advance toward the one-way mirror 306, solid or flashing green lighting around the one-way mirror 306 perimeter when a security article user is being requested to advance toward the one-way mirror 306, solid or flashing blue or again green lighting when the security article user has successfully completed a process at the security checkpoint 300, and flashing red lighting when a process has failed or a security article user is being flagged for further intervention. Other color coding combinations are possible. In some embodiments only a silent alarm is triggered and no indication to the security article user is made that a process has failed or that further intervention is required.

Additionally or alternatively, non-transparent material may be used for all or portions of the mirror frame 304 to better conceal the frame equipment. In such embodiments, the mirror frame 304 is angled relative to the one-way mirror 306. In variations, the mirror frame 304 may extend at any angle, including multiple angles, and may be curved for example. The mirror frame 304 may include one or more apertures, such as for accommodating flush-mounted or outwardly projecting frame equipment.

In some embodiments, the frame equipment includes one or more ultrasound detectors, ultrasound transducers, ultrasonic transceivers, other sound-based data recordation equipments, and combinations thereof. The ultrasound detector, ultrasound transducer, ultrasonic transceiver or similar may be concealed or unconcealed as suits particular uses of the security checkpoint 300. In some embodiments, ultrasound or ultrasonic equipment is flush-mounted at an aperture in the mirror frame 304. In some embodiments, the mirror frame 304 built-in equipment includes a proximity detector for detecting the presence of an external object or individual at the security checkpoint 300. In some embodiments, the proximity detector is operable to provide an indication of the distance between the proximity detector and the sensed object or person. The proximity detector may be flush-mounted at an aperture in the mirror frame 304, for example.

In some embodiments, various types of sources of the frame equipment are paired with corresponding cameras, detectors and/or sensors of the frame equipment to provide imaging, detecting and/or sensing, respectively, of reflected electromagnetic radiation. For example, a source disposed proximate to the mirror frame 304 along one vertical or horizontal side of the one-way mirror 306 may be paired with a corresponding camera and/or detector disposed proximate to the mirror frame 304 along an opposing vertical or horizontal side of the one-way mirror 306. The source and the corresponding camera and/or detector, and possibly the mirror frame 304, are angled such that an external object or individual at an appropriate location within the security checkpoint 300 will reflect electromagnetic radiation produced by the source toward the corresponding camera and/or detector. By such opposing side arrangement, electromagnetic radiation received by the corresponding camera and/or detector is electromagnetic radiation reflected from the external object or individual at the security checkpoint 300 under exposure to illumination by the source. The pairings of sources and corresponding cameras and/or detectors can be of a variety of types to suit particular uses of the security checkpoint 300. For example, an IR source may be paired with an IR camera and/or IR detector; an UV source may be paired with an UV camera and/or UV detector; an UV source may be paired with a visible light camera and/or visible light detector; an ultrasonic transceiver may be paired with a corresponding ultrasonic transceiver and/or ultrasound detector; etc. Multiple arrays of frame equipment pairs may be employed simultaneously or in sequence for data recordation associated with various distances from the one-way mirror 306, for example.

In some embodiments, one or more cameras of the mirror frame built-in equipment are installed inside the security checkpoint housing 302 at the lower section of the mirror frame 304 just below the one-way mirror 306 and directed upwardly and externally, so as to attempt to capture an image of the face of a security article user who avoids looking directly at the one-way mirror 306 by looking downwardly. Such upwardly directed cameras, which may be visible light cameras for example, may be concealed by virtue of their small size, by configuring such cameras to capture images through small-sized apertures in the mirror frame 304, by at least a portion of the mirror frame 304 being made of a semi-opaque material, by at least a portion of the mirror frame 304 being made of a half-silvered glass material, by other means of concealment, or any combination thereof for example.

The security checkpoint 300 in various embodiments includes various concealed equipments to suit particular uses of the security checkpoint 300 at positions and locations other than behind the one-way mirror 304 and other than near the mirror frame 304. While not visible in FIG. 3, the security checkpoint 300 may include any combination of one or more cameras, detectors, sensors and sources at any position and location of the security checkpoint 300. For example, various cameras, proximity detectors and/or motion detectors may be employed to determine the location of each object or individual within or near the security checkpoint 300.

The security checkpoint 300 in various embodiments includes various unconcealed equipment at various positions and locations throughout the security checkpoint 300 to suit particular uses of the security checkpoint 300. The security checkpoint 300 includes a display 310, which can be used in addition or alternatively to the display features of the one-way mirror 306. Typically, the display 310 is a liquid crystal display (LCD). In some embodiments, the display 310 is a touchscreen display providing both user input and output functions. As can be seen in FIG. 3, the position of the display 310 advantageously permits touchscreen user input at a non-vertical angle which may be more comfortable for certain individuals and purposes. For example, the display 310 may be used for receiving as touchscreen user input the signature of a security article user, a security officer or a maintenance person at the security checkpoint 300. Additionally or alternatively, a fully horizontal user input device (not shown) may be used for receiving signatures.

In further embodiments, the security checkpoint 300 is operable to display information on the one-way mirror 306 so that the information is visible to a security article user, a security officer or a maintenance person present at the security checkpoint 300. The hidden equipment may include a display controller for controlling the display of output information on the one-way mirror 306. The information may include instructions to a security article user at the security checkpoint 300, prompts or questions intended for the security article user to respond to, and status information, for example. In the present embodiment, the display controller is enclosed within the security checkpoint housing 302. In some embodiments, however, the display controller is not hidden behind the one-way mirror 306. In such embodiments, the generally reflective view of a security article user standing in front of the one-way mirror 306 needs not be disrupted by the display of information and acceptance of input by touchscreen technique. In some cases, however, portions of the one-way mirror 306 may be obscured by the use of the one-way mirror 306 for input/output functions. Further, in the embodiments in which the one-way mirror 306 is operable to display information, the display 310 can be replaced by a printer system such as those described herein.

In further embodiments, the one-way mirror 306 is full length (not shown in FIG. 3) and extends from adjacent or near the floor of the security checkpoint 300 to a height that it at least slightly greater than the tallest expected height of a typical security article user (not shown). A full length one-way mirror 306 advantageously permits measurements and other data recordation along the full height of the security article user, for example. However, if the size and vertical position of a smaller mirror permits, similar results can be achieved with such a smaller mirror. For example, a small mirror can be used to determine the position of a top of a head. Furthermore, a larger or additional mirror can be employed to determine a heel height. In embodiments where the one-way mirror 306 is full length, unconcealed peripherals such as a printer system and/or a secondary display, for example, can be positioned at a suitable height beside the full length one-way mirror 306 (not shown).

The security checkpoint apparatus may further comprise a recording equipment being, preferably, concealed by the one-way mirror 306 or its frame. The recording equipment may include a camera. The camera may be a still-image camera for capturing still images. The camera may be a video camera for capturing video information. The camera may be a video camera for capturing audio-video information. The camera may be a VIS (visible light) camera operable to capture images in the VIS (visible) light region of the electromagnetic spectrum. The camera may be an IR (infrared) camera operable to capture images in the IR (infrared) region of the electromagnetic spectrum. The camera may be an IR camera operable to capture video information in the IR region of the electromagnetic spectrum. The camera may be a thermographic camera. The camera may be a stereoscopic camera for capturing three-dimensional images. The camera may be a stereoscopic camera for capturing three-dimensional video information. The camera may be a stereoscopic camera for capturing three-dimensional video information and audio information. The recording equipment may include a plurality of cameras of the same type or of cameras of different types. The recording equipment may include an array or multiple arrays of cameras.

In some embodiments, the hidden equipment includes at least one camera for capturing video images of the individual at the security checkpoint 300. In some embodiments, multiple cameras at different heights are installed behind the one-way mirror 306 to better capture features, such as the faces, of persons of different heights. In some embodiments, multiple cameras oriented at different angles are installed behind the one-way mirror 306 to better capture features of persons at the security checkpoint 300. Additionally or alternatively, one or more cameras may be installed at other concealed and/or unconcealed locations of the security checkpoint 300 for capturing images at a variety of positions and locations within and/or around the security checkpoint 300. The mentioned camera(s) may preferably be sensitive and configured for light in the visible (VIS) wavelength spectrum. Likewise, the camera(s) may be sensitive and configured for light in the infrared (IR) and/or ultraviolet wavelength spectrum, or any combination of VIS, IR, and UV. In a sense, the mentioned cameras may act as biometric data capturing devices.

Specifically, one or more cameras such as those described herein may include filtering or otherwise be particularly suitable for capturing images and/or videos within particular regions of the electromagnetic spectrum. For example, one or more cameras such as those described herein may be thermal or IR (infrared) cameras suitable for detecting and imaging electromagnetic radiation in the IR (infrared) region of the electromagnetic spectrum. IR cameras may be used to produce images associated with the black body radiation emitted by the security article user at the security checkpoint 300. In some embodiments, the IR camera is operable to produce a measurement of the body temperature at the security checkpoint 300 or of particular parts of the security article user (not shown).

In some embodiments, the camera is a stereoscopic camera operable to capture three-dimensional images such as 3D still-images and/or 3D video information. In some embodiment, at least one camera is a visible light camera operable to detect and image electromagnetic radiation in the visible light region of the electromagnetic spectrum. In variations, the visible light camera is operable to capture still-images, video information, or both still-images and video information. Additionally, the visible light camera is typically operable to record audio information.

In some further embodiments, the camera or an additional camera is provided as a "near-the-ground" camera, in the sense that such a camera is operable to capture an image of a security article user who avoids looking at the mirror 306. Detecting the event that a security article user looks "near-the-ground" may serve as an indication for the evasiveness as mentioned and described elsewhere in the present disclosure.

In some further embodiments, the recording equipment may comprise an audio recorder. Specifically, such embodiments may provide related components, such as a microphone, a digital signal processor (DSP), an analogue to digital converter (ADC), an audio sampler, a memory device, and the like. In yet further embodiments, the recording equipment may comprise a thermal sensor and/or a vibration sensor.

In some further embodiments, the recording equipment may comprise a motion detector, preferably arranged as part of frame equipment in the frame. The motion detector may be configured to detect the motion of an external object or person at the security checkpoint 300. The motion detector may be flush-mounted at an aperture in the mirror frame 304, for example, so it is hard to be recognized from the outside.

As means for reading, evaluating, and processing a presented security article, the checkpoint 300 may include a security article scanner (or reader) 314 as a biographic information capturing device. Typically, the security article scanner 314 is operable to receive a security article 200 through its receiving slot 316 and to scan or read the security article to produce recorded data associated with the security article user at the security checkpoint 300. In variations, the security article scanner 314 may be dimensioned to receive and scan a security article 200. In some embodiments, the security checkpoint 300 may include multiple security article scanners 314 (see FIG. 4B) dimensioned for different types of security articles. In some embodiments, the receiving slot 316 also acts as an output slot for ejection and/or removal of the security article and/or document from the security article scanner 314. Additionally or alternatively, one or more cameras and/or detectors of the hidden equipment may be employed to image and/or detect, respectively, a security article and/or document placed against the one-way mirror 306 by a security article user at the security checkpoint 300. In addition, as with the apparatus 100, the security article scanner 314 may include a security feature detector (not shown) to detect a physical property of a security feature on and/or in the security article 200 inserted into the security article scanner 314.

The security feature detector in the security article scanner 314 is typically the same as the security feature detector in the apparatus 100 as described in conjunction with FIG. 1 and operates in the same, similar or adapted manner. Also, if appropriate, depending on the physical property being detected a stimulation source to stimulate or activate the physical property of the security feature is also provided in the security article scanner 314.

In some embodiments, the security article scanner 314 includes an integrated printer as output device, said printer system being operable to print on the security article and/or document (i.e. a document different from the security article, such as for example a certificate of authenticity or any other issued document separate from the scanned security article being presented by the security article user) after the security article and/or document has been received by the security article scanner 314., The printer is an output device to output a signal indicative of the determination whether the security article user is an authorized user and the security article is genuine. The printer system may be of any suitable type such as those described herein. The security checkpoint 300 may further comprise scanner equipment. Preferably, such scanner equipment comprises any one of a finger print scanner, a palm print scanner, a face scanner, and an X-Rays scanner. Specifically, in one embodiment, the security checkpoint 300 includes also a fingerprint scanner as biometric data capturing device. Such a fingerprint scanner may be the biometric data capturing device 104 shown in FIG. 1 or the biometric data capturing device 312 as shown in FIG. 3. Typically, the biometric data capturing device 312 is operable to scan e.g. a finger being received by the biometric data capturing device 312 and to produce an indication of the fingerprint associated with the individual such as security article user, a security officer or a maintenance person, at the security checkpoint 300. Additionally or alternatively, further biometric data capturing devices may be employed, e.g. an unconcealed palm-print scanner may be employed to scan the entire palm-print of the security article user, the security officer or the maintenance person. Additionally or alternatively, one or more cameras and/or detectors of the hidden equipment may be employed to image and/or detect, respectively, the fingerprint and/or palm-print of a security article user, a security officer or a maintenance person placing his/her finger and/or palm, respectively, against the one-way mirror 306.

The security checkpoint 300 may further comprise equipment, or a device, for permitting use of the security checkpoint, or parts thereof, such as the parts related to reading and scanning and/or the parts related to printing. This equipment may, in general, identify a security officer or a maintenance person, for which any required operation access is granted in response to some authentication procedure. Identifying and authenticating such a security officer or maintenance person may involve operating a biometric data capturing device for determining that a presented security officer or maintenance person is permitted use. Further, identifying and authenticating such a security officer or maintenance person may involve operation of a passcode reader, which, in turn, may involve presenting to a security officer or maintenance person an instruction to provide (enter) a passcode and receiving any passcode to be input.

Identifying and authenticating such a security officer or maintenance person may involve prompting the security officer or maintenance person for a passcode. Identifying a security officer or maintenance person may involve receiving as user input the passcode. Identifying a security officer or maintenance person may involve determining whether the received passcode is associated with the stored biometric profile. The method may involve permitting use by the security officer or maintenance person of an output system, in particular a printer system. Permitting use by the security officer or maintenance person of a printer system may involve permitting use by the security officer or maintenance person of a housed printer system. The method may involve permitting use by the security officer or maintenance person of a reader station.

Identifying and authenticating such a security officer or maintenance person may involve permitting access to a printer system. Permitting access to a printer system may involve unlocking a printer inlet flap, e.g. 162. Permitting access to a printer system may involve releasing the printer inlet flap. Permitting access to a printer system may involve moving the printer inlet flap to expose an opening defined by the printer inlet flap. Permitting access to a printer system may involve enabling the printer system. Permitting access to a printer system may involve powering up the printer system. Permitting access to a printer system may involve moving the printer system to a receiving position.

The security checkpoint 300 may further include an imaging device (not shown) such as a camera disposed within the security checkpoint housing 302 and directed toward the typical location of the face of a maintenance person opening the security checkpoint housing 302 for servicing and/or maintenance. The apparatus 100 or, in general, the security checkpoint, e.g. the security checkpoint 300 as such, is operable to capture an image, including possibly a streaming video of images, whenever the security checkpoint housing 302 is opened in the manner of servicing, and operable to record the image or images in a record log associated with the apparatus 100 or with the security checkpoint 300.

In further embodiments, the security checkpoint 300 includes visible lighting, such as LEDs, at or around the perimeter of one or more of the display 310, such as biometric data capturing devices (e.g. 312), security article scanner 314 and entrance display 318. In the present embodiment, various colored LEDs are located proximate to each of the display 310, biometric data capturing devices (e.g. fingerprint scanner) 312, security article scanner 314 and entrance display 318, such that a security article user, security officer or maintenance person at the security checkpoint 300 can be guided by the simultaneous or sequential use of colored LEDs.

For example, the entrance display 318 may be framed by solid or flashing green lighting when security article user is being requested to advance toward the security checkpoint 300. Upon detecting that the security article user has advanced some distance toward the main area of the security checkpoint 300, the security article scanner 314 may become lit up with solid or flashing green lighting while instructions to insert a specified security article and/or document into the security article scanner 314 is displayed. Upon completion of a process at the security article scanner 314, the security article scanner 314 lighting may then be de-activated and the biometric data capturing device 312 become lit up with solid or flashing green lighting to assist in guiding the security article user to use the biometric data capturing device 312. It will be appreciated that by sequential, color-coded lighting a security article user may be guided through the complete security checkpoint 300 process (described further herein below). Additionally or alternatively, lighting can be employed at other positions and locations of the security checkpoint 300, such as overhead for general lighting and/or along a floor of the security checkpoint 300 to guide a security article user's footsteps as the security article user advances toward and/or through the security checkpoint 300.

The security checkpoint 300 of the present embodiment may include a speaker 320 for producing audio, such as voice commands, instructions and/or requests. The security checkpoint 300 may also include a microphone 322 for receiving audio, such as speech or other sounds made by an individual such as security article user, a security officer or a maintenance person at the security checkpoint 300. In the present embodiment, the security checkpoint 300 is operable to record audio received by the microphone 322.

The security checkpoint 300 further includes an exit gate 324 for denying or granting access to exit the security checkpoint 300. Typically, the exit gate 324 is operated automatically upon completion of the security checkpoint 300 process, e.g. when it is determined that a presented security article is genuine and the corresponding security article user is an authorized user of the security article. In a way, the operation of exit gate 324 may be in response to the signal indicative of the determination as discussed elsewhere in the present disclosure.

Figure 4A:
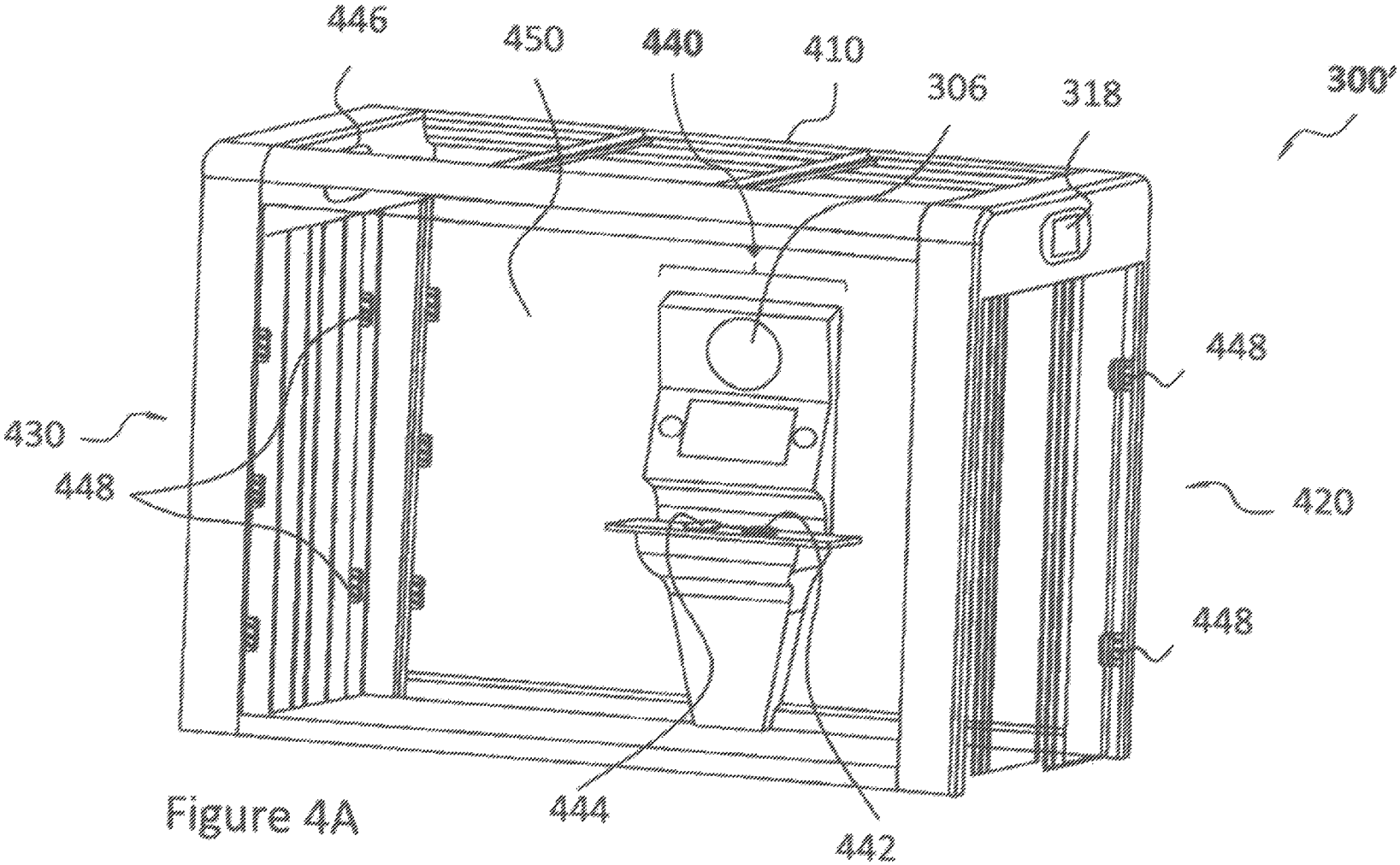
FIG. 4A shows a schematic view of an electronic gate, for example as part of automatic border control, according to an embodiment of the present invention.
Figure 4B:
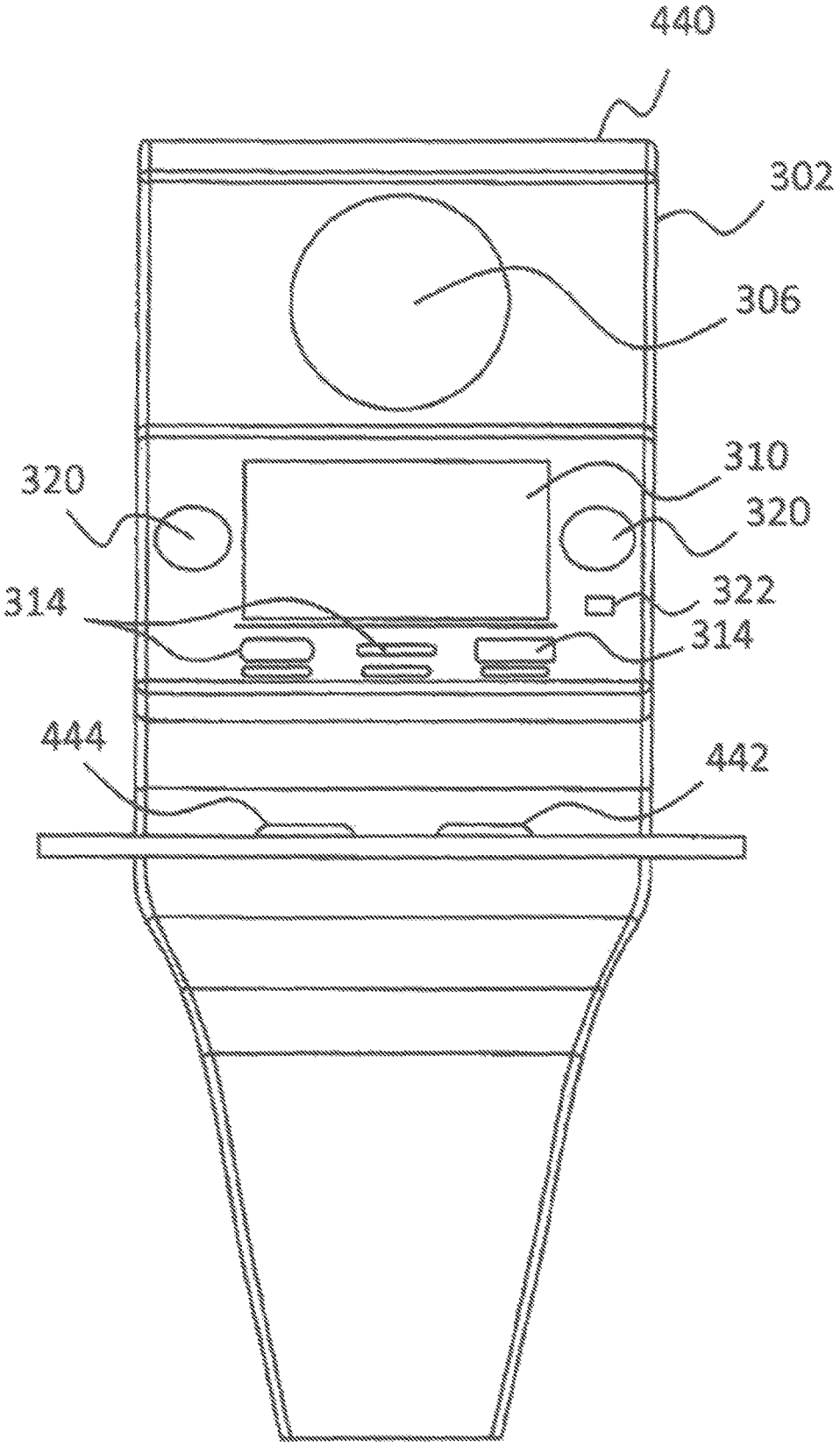
FIG. 4B shows a schematic view of a security console according to an embodiment of the present invention and, for example, as part of the configuration as shown and explained in conjunction with FIG. 4A.

FIG. 4A shows a schematic view of an embodiment in which the apparatus in the form of a security console 440 is placed inside some type of enclosure. Specifically, the electronic gate 300' (for example as part of automatic border control) is formed, as a security checkpoint according to a respective embodiment, by an enclosure being accessible by two portals 420, 430. One can be considered as an entrance, the other can be considered as an exit. FIG. 4B then shows a schematic view of details of the embodiment of the apparatus in the form of a security console 440. This security console 440 can be arranged together with and/or in the vicinity of an associated exit gate as shown in FIG. 4A or in any other suitable configuration without the elements additionally shown in FIG. 4A. From the functional point of view, the security console 440 as described here may be similar or equivalent to the apparatus 100 as described in conjunction with FIG. 1.

Referring now to FIGS. 4A and 4B, the electronic gate 300' (for example as part of automatic border control) as a security checkpoint in accordance with the respective embodiment includes a security console 440 disposed within an enclosure 410 having an entrance portal 420 and an exit portal 430. The security console 440 includes a one-way mirror 306 such as those described herein, behind which is the hidden equipment (not visible in FIGS. 4A and 4B). The one-way mirror 306 is shown as having a generally circular shape, although any suitable shape may be used for any one-way mirror 306, including oval, square, polygonal, irregular, other shapes, and any combination thereof for example. In some embodiments, a plurality of one-way mirrors 306 may be used.

The security console 440 also includes a display 310 such as those described herein, which in the present embodiment is a touchscreen LCD; one or a pair of speakers; and a microphone. The security console 440 may include more than one security article scanners 314, for example two or three scanners, dimensioned to accept security articles of different sizes. In further embodiments, any number of differently dimensioned security article scanners may be suitably used in various embodiments. The security console 440 includes, for example, a security article reader 442 for reading e.g. passport booklets and a printer system 444, which in at least some embodiments is a stamp printer 444 for printing official stamps on passport booklets.

The entrance display 318 is mounted on the enclosure 410 above the entrance portal 420. The electronic gate 300' of the present embodiment also includes an exit display 446 mounted on the inside of the enclosure 410 above the exit portal 430. In the present embodiment, the electronic gate 300' is operable to coordinate the information displayed on the entrance display 318 and the status of the entrance portal 420 (e.g. locked or unlocked status) such that a security article user is permitted to enter the electronic gate 300' through the entrance portal 420 when the entrance display 318 is displaying an invitation for a next security article user to enter the electronic gate 300'. Similarly, the electronic gate 300' in the present embodiment is operable to coordinate the information displayed on the exit display 446 and the status of the exit portal 430 such that a security article user is permitted to exit the electronic gate 300' through the exit portal 430 when the exit display 446 is displaying an invitation for the security article user currently inside the enclosure 410 to exit the electronic gate 300'.

While FIG. 4A shows the entrance portal 420 and the exit portal 430 as having hinges 448 to permit the portals 420 and 430 to open and close by swinging horizontally, other doorway types are possible. For example, in some embodiments the portals 420 and 430 open and close by swinging vertically. In some embodiments, the portals 420 and 430 open and close by sliding horizontally and/or vertically. In some embodiments, the portals 420 and 430 open and close automatically, such as under the control of the controller for example.

While the one-way mirror 306 is shown disposed at approximately head-height, the one-way mirror 306 may have any suitable size and be installed at any suitable height. For example, the electronic gate 300' may include a full height one-way mirror 306, which may be adjacent the security console 440 such as being disposed along the side wall 450 of the enclosure 410. In general, however, the functionalities in conjunction with one-way mirror 306 of FIGS. 4A and 4B may be any one of the functionalities as described in conjunction with one-way mirror 306 of FIG. 3.

In some embodiments (not shown), the exit portal 430 may include a one-way mirror, including possibly a full length one-way mirror, for collecting security article user information, biometric data, behavioral analysis data, other security data relating to the security article user at the electronic gate 300', or any combination thereof for example. In such embodiments where the exit portal 430 includes a one-way mirror operable to display information and accept user input, including accepting touchscreen user input, scanning fingerprints and/or palm-prints and scanning security articles and/or documents, one or more functional elements of the security console 440 may not be needed at the security console 440. It is contemplated, however, that printer functions would typically remain at the security console 440 or at a similar wall-mounted or table-mounted printing device. In such embodiments, the exit portal 430 would preferably be of the automatically-controlled, horizontally-sliding type (including possibly being a split doorway that opens and closes by two half-doors sliding in opposing horizontal directions), but all types of doorways are possible. Also in such embodiments, the entrance portal 420 is optional as is the extended distance between the entrance portal 420 and the exit portal 430.

By way of further specific examples, in some embodiments the biometric information capturing device 312 of the security checkpoint 300 or of the electronic gate 300' is operable to perform some or all of the scanning functions of the biometric scanner of the apparatus 100; in some embodiments, the biographic information capturing device of the security checkpoint 300, or of the electronic gate 300' is operable to perform some or all of the scanning functions of the biographic information capturing device of the apparatus 100; in some embodiments, the display 310 of the security checkpoint 300, or of the electronic gate 300' is operable to perform some or all of the display functions of the display 106 of the apparatus 100; in some embodiments, the security article scanner 314 of the security checkpoint 300, or of the electronic gate 300' is operable to perform some or all of the scanning functions of the reader system 214 of the apparatus 100; in some embodiments, the security article reader 442 of the security checkpoint 300 and of the electronic gate 300' is operable to perform some or all of the reading functions of the reader support system 150 of the apparatus 100. By way of a non-limiting example, the security checkpoint 300, and the electronic gate 300' in some embodiments include the apparatus 100 and the RFID station for processing security articles containing RFID elements (not shown) or otherwise having RFID technology associated therewith.

In general, however, the security checkpoints and apparatuses in accordance with further embodiments may also include a hand-luggage scanner for allowing accomplishing the task of luggage control at the same point of authenticating a security article (e.g. passport). Such scanners may employ X-rays scanning, Terahertz scanning, Raman scanning, etc.

In general, however, the apparatuses, security checkpoints and eGates in accordance with any embodiment thereof may be operable to perform one or more functions described herein above in relation to the apparatus 100 in accordance with any embodiment thereof and may include one or more components described herein above in relation to the apparatus 100 in accordance with any embodiment thereof.

Also described herein is a general method for authenticating a security article so as to assess whether the security article is genuine and, whether the security article user is an authorized user of the security article. The method according to this general embodiment comprises a step a) of capturing biographic information from the security article, a step b) of detecting a physical property of a security feature on and/or in the security article 200, a step c) of processing the captured biographic information and the detected physical property to determine whether the security article is genuine, and a step d) of outputting a signal indicative of the determination.

Also described herein is a general operation mode comprising a step a) wherein a security article user is identified, for example by means of reading and processing the biographic information and optionally the biometric data. In such cases, the biographic information capturing device would capture the biographic information from the security article 200. The security article user is the one being associated to the security article. In this sense, a security officer, in particular a border control officer could operate the apparatus but the security article user will be the individual whose security article is checked.

In step b), a processor directs to permit use by the security article user or the security officer of the apparatus 100, such as by enabling various functions of the apparatus 100. For example, one or both of the biographic information capturing device and output device, e.g. a printer system such as those described herein, may be enabled. Enabling a function of the apparatus 100 may involve setting a flag or register value to indicate an associated functional feature of the apparatus 100 is enabled. Also a sound indication may be given.

Then, in step c), the processor directs to cause the apparatus to authenticate the security article 200 when it is presented by the security article user or the security officer to the apparatus. Authenticating the security article 200 may include performing a verification of the security article 200. Verifying the security article 200 involves determining whether information appearing on or and/or in the security articles 200 in accordance with national or international standards indicates tampering, counterfeiting and/or illegal reproduction of the security article 200 has occurred. At this stage, the security feature detector detects a physical property of a security feature on and/or in the security article and the detected physical property is processed to determine whether the security article is genuine.

In step d), the processor directs to permit access to the output device, in particular a printer system. When a printer system is used, access may be permitted by releasing or unlocking the printer inlet flap 162, turning on the printer system if not already on, and enabling the printer system if not already enabled, for example. Permitting access may also involve moving components of the printer system to their receiving positions if such components are not already in their receiving positions, respectively. In step e) the processor directs to cause the apparatus 100 to determine the printing area for printing by the printer system. Typically, the printing area of the security article 200 and/or a document (said document being different from the security article and being for example a certificate of authenticity or any other issued document as described hereabove) is confined within its printable area.

In step e) the processor directs to print on the authenticated security article 200 and/or document, within the printing area. Printing within the printing area typically involves printing within the printing area as described herein. Printing typically involves operating the printhead in any suitable manner, including causing the printhead to move transversely along a printhead guide (not shown). In some embodiments, printing involves first moving the printer system and the security article 200 and/or document from the imaging position of the printer system to the print-start or other printing position of the printer system. For example, in some embodiments the imaging position places the security article 200 and/or document at a different vertical height than the printing position. In some embodiments, the security article 200 and/or document is moved some distance away from the printing position and then the security article 200 and/or document is moved toward the printing position.

In some embodiments comprising a printer system as output device, printing on different print lines involves pulling the security article 200 and/or document clamped at its leading edge by effecting longitudinal movement of a platen (see respective embodiments) and the transport frame in a direction which may be away from the printer inlet 160, toward the printer outlet, or both away from the printer inlet 160 and toward the printer outlet for example. In general printer inlet and outlet can be implemented by the same means in the sense that the security article 200 and/or document is inserted into and ejected from the same slot or opening. In another embodiment, printing on different print lines involves pulling the security article 200 and/or document clamped at its leading edge by effecting longitudinal movement of the clamping frame in a direction which may be away from the printer inlet 160, toward the printer outlet, or both away from the printer inlet 160 and toward the printer outlet for example. Longitudinal movement of the platen and the transport frame or the clamping frame may be effected by any suitable linear motion system. For example, the printer system may be operable to cause longitudinal movement of the clamping frame along with the rack.

In some embodiments comprising a printer system as output device, the printer system is operable, after all desired printing is completed, to continue pulling the security article 200 and/or document until the security article 200 and/or document is at an ejection position of the printer system which is suitable for subsequent ejection of the security article 200 and/or document out of the apparatus 100, unless the printing operation itself resulted in the security article 200 and/or document being at the ejection position (e.g. where printing occurred on the last available printing line within the printable area and the resulting printed position coincides with the ejection position of the printer system).

Upon completion of printing in step e), the method proceeds to step f), wherein the processor directs to cause the printer system to release the printed security article 200 and/or document. Releasing the printed security article 200 and/or document may involve moving the security article 200 and/or document longitudinally to an ejection position of the printer system if the security article 200 and/or document is not already at the ejection position of the printer system.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

Although detailed embodiments have been described, these only serve to provide a better understanding of the invention defined by the independent claims, and are not to be seen as limiting.

In the Figures, the numbers designate:

100 Apparatus
102 Apparatus housing
104 Biometric data capturing device
106 Display
108 Indicators
110 Pushbuttons
150 Reader support system
152 Reader support
154 Receiving flange
156 Receiving slot
158 Distal end of receiving slot
160 Printer inlet
162 Printer inlet flap
164 Biographic information capturing device
166 Security feature detector
200 Security article
202 Biographic information
204 Exemplary security feature
206 MRZ (Machine Readable Zone)
300 Security checkpoint
300' electronic gate (for example as part of automatic border control)
302 Security checkpoint housing
304 Mirror frame
306 One-way mirror
308 Outer side of one-way mirror
310 Display

312 Biometric data capturing device (e.g. fingerprint capturing device)
314 Security article scanner
316 Receiving slot
318 Entrance display
320 Speaker
322 Microphone
324 Exit gate
326 Entrance
410 Enclosure
420 Entrance portal
430 Exit portal
440 Security console
442 Security article reader
444 Printer system
446 Exit display
448 Hinges
450 Side walls

The invention claimed is:

1. A security checkpoint for authenticating a security article, the security checkpoint comprising:

a biographic information capturing device configured to capture biographic information from the security article;

a security feature detector comprising an optical detector configured to detect an optical property of a security feature selected from light intensity of emitted, reflected or absorbed light, light emission wavelength, reflection wavelength, absorption wavelength and light polarization, the security feature being in a form of an image or graphic element on or in the security article; and a gate moveable between a closed position and an open position;

wherein the captured biographic information and the detected optical property of the security feature on or in the security article are configured to be processed to determine whether the security article is genuine, and the gate is operable to be moved from the closed to the open position depending on the determination, and wherein the security checkpoint further comprises a localization device for identifying the location of the security checkpoint.

2. The security checkpoint according to claim 1, further comprising a biometric data capturing device configured to capture biometric data from a security article user, wherein the captured biometric data is configured to be compared with the captured biographic information to at least partially determine whether the security article user is an authorized user of the security article.

3. The security checkpoint according to claim 1, further comprising a processor configured to perform the processing of the captured biographic information and the detected optical property and the determining of whether the security article is genuine.

4. The security checkpoint according to claim 1, wherein the security feature detector comprises at least one of a magnetic detector and a conductivity meter.

5. The security checkpoint according to claim 1, further comprising a stimulus device configured to activate the optical property of the security feature.

6. The security checkpoint according to claim 1, wherein the biographic information capturing device comprises at least one of a camera, an optical scanner and an electronic data capturing device.

7. The security checkpoint according to claim 6, wherein the electronic data capturing device comprises a wireless device configured to wirelessly capture the biographic information from an electronic storage device attached to the security article.

8. The security checkpoint according to claim 1, further comprising a security article receiving device adapted to receive the security article and to capture from the security article the biographic information and the optical property of the security feature.

9. The security checkpoint according to claim 1, wherein the localization device is operable to produce an alarm signal if the location of the security checkpoint is not within a pre-defined location and to disable the security checkpoint if the security checkpoint is removed from the pre-defined location.

10. The security checkpoint according to claim 1, wherein the localization device is operable to disable the security checkpoint if the security checkpoint is removed from the pre-defined location.

11. A method for operating the security checkpoint of claim 1 and for authenticating a security article, comprising the steps of:

capturing biographic information from the security article;

detecting an optical property of a security feature selected from light intensity of emitted, reflected or absorbed light, light emission wavelength, reflection wavelength, absorption wavelength and light polarization, the security feature being in a form of an image or graphic element on or in the security article;

processing the captured biographic information and the detected optical property on or in the security article to determine whether the security article is genuine; and operating a gate, moveable between a closed position, to be moved from the closed to the open position depending on the determination.

12. The method according to claim 11, further comprising a step of capturing biometric data from a security article user, and a step of comparing the captured biometric data with the captured biographic information to at least partially determine whether the security article user is an authorized user of the security article.

13. The method according to claim 11, wherein the step of detecting the optical property comprises further detecting at least one of a magnetic property of the security feature and an electrical property of the security feature.

14. The method according to claim 11, further comprising activating the optical property by subjecting the security feature to an external stimulus.

15. The method according to claim 11, wherein the biographic information is captured by at least one of optically scanning the security article, capturing an image of the security article, and capturing electronic data from an electronic memory device attached to the security article.

* * * * *